US011699583B2

(12) United States Patent
Bajic et al.

(10) Patent No.: US 11,699,583 B2
(45) Date of Patent: Jul. 11, 2023

(54) IMPACT IONISATION ION SOURCE

(71) Applicant: Micromass UK Limited, Wilmslow (GB)

(72) Inventors: Stevan Bajic, Sale (GB); Jeffery Mark Brown, Hyde (GB)

(73) Assignee: Micromass UK Limited, Wilmslow (GB)

( * ) Notice: Subject to any disclaimer, the term of this patent is extended or adjusted under 35 U.S.C. 154(b) by 0 days.

(21) Appl. No.: 17/259,482

(22) PCT Filed: Jul. 4, 2019

(86) PCT No.: PCT/GB2019/051891
§ 371 (c)(1),
(2) Date: Jan. 11, 2021

(87) PCT Pub. No.: WO2020/012163
PCT Pub. Date: Jan. 16, 2020

(65) Prior Publication Data

US 2021/0280408 A1 Sep. 9, 2021

(30) Foreign Application Priority Data

Jul. 11, 2018 (GB) ..... 1811383

(51) Int. Cl.
*H01J 49/16* (2006.01)
*H01J 49/00* (2006.01)
*H01J 49/04* (2006.01)

(52) U.S. Cl.
CPC ..... *H01J 49/165* (2013.01); *H01J 49/0072* (2013.01); *H01J 49/045* (2013.01); *H01J 49/16* (2013.01)

(58) Field of Classification Search
CPC .... H01J 49/045; H01J 49/0072; H01J 49/165; H01J 49/16
See application file for complete search history.

(56) References Cited

U.S. PATENT DOCUMENTS 4,823,009 A * 4/1989 Biemann ..... G01N 30/84 250/341.4
5,879,949 A 3/1999 Cole et al.
(Continued)

FOREIGN PATENT DOCUMENTS

GB 2507297 A 4/2014
GB 2507298 A 4/2014
(Continued)

OTHER PUBLICATIONS

International Search Report and Written Opinion for International Application No. PCT/GB2019/051891, dated Oct. 14, 2019.
(Continued)

*Primary Examiner* — Wyatt A Stoffa
(74) *Attorney, Agent, or Firm* — Goodwin Procter LLP

(57) ABSTRACT

An ion source is provided comprising a nebuliser or electrospray probe (1) for nebulising a sample and an impact surface or target electrode (5). The impact surface or target electrode (5) comprises a tarnishable or oxidisable metal or an alloy comprising a tarnishable or oxidisable metal. Also provided is an ion source comprising a nebuliser or electrospray probe with a central wire comprising a tarnishable or oxidisable metal or an alloy comprising a tarnishable or oxidisable metal or an alloy comprising a tarnishable or oxidisable metal. Adducts with relatively heavy metals result in simplified multiply-charged mass spectra that are easier to interpret.

10 Claims, 16 Drawing Sheets

(56) References Cited

U.S. PATENT DOCUMENTS

| | | | | |
|---|---|---|---|---|
| 7,247,495 | B2 * | 7/2007 | Amirav | G01N 30/72 250/281 |
| 7,368,728 | B2 * | 5/2008 | Cristoni | H01J 49/0468 250/281 |
| 8,742,337 | B2 * | 6/2014 | Jones | H01J 49/145 427/523 |
| 8,941,060 | B2 * | 1/2015 | Satake | H01J 49/0431 250/281 |
| 9,117,642 | B2 * | 8/2015 | Bajic | H01J 49/10 |
| 9,437,398 | B2 * | 9/2016 | Tomany | H01J 49/16 |
| 10,020,177 | B2 * | 7/2018 | Bajic | H01J 49/16 |
| 10,217,622 | B2 * | 2/2019 | Bajic | H01J 49/142 |
| 2006/0022130 | A1 * | 2/2006 | Bousse | H01J 49/165 250/288 |
| 2006/0145089 | A1 * | 7/2006 | Cristoni | H01J 49/145 250/423 F |
| 2009/0101810 | A1 * | 4/2009 | McLean | H01J 49/0031 250/282 |
| 2013/0087700 | A1 * | 4/2013 | Alusta | H01J 49/0409 250/282 |
| 2013/0299691 | A1 * | 11/2013 | Jones | H01J 49/10 250/288 |
| 2013/0341503 | A1 * | 12/2013 | Whitehouse | H01J 49/045 250/288 |
| 2014/0183350 | A1 * | 7/2014 | Brown | H01J 49/10 250/288 |
| 2014/0323330 | A1 * | 10/2014 | Bergo | G01N 33/6851 506/18 |
| 2014/0353489 | A1 * | 12/2014 | Szalay | H01J 49/0031 250/288 |
| 2015/0021469 | A1 * | 1/2015 | Bajic | H01J 49/16 250/288 |
| 2015/0144782 | A1 * | 5/2015 | Fogwill | H01J 49/0431 250/288 |
| 2015/0287581 | A1 * | 10/2015 | Bajic | H01J 49/0454 250/423 P |
| 2016/0225601 | A1 * | 8/2016 | Bajic | H01J 49/165 |
| 2020/0258729 | A1 * | 8/2020 | Karancsi | A61B 5/00 |
| 2021/0265151 | A1 * | 8/2021 | Murtazin | H01J 49/045 |
| 2021/0280408 | A1 * | 9/2021 | Bajic | H01J 49/16 |
| 2022/0128570 | A1 * | 4/2022 | Bergo | G01N 33/6848 |

FOREIGN PATENT DOCUMENTS

| | | | |
|---|---|---|---|
| GB | 2565870 | A | 2/2019 |
| JP | 03001435 | A | 1/1991 |
| JP | 2000097913 | A | 4/2000 |
| WO | 2004034011 | A2 | 4/2004 |
| WO | 2014064399 | A1 | 5/2014 |
| WO | 2014064400 | A1 | 5/2014 |
| WO | 2018189558 | A1 | 10/2018 |
| WO | 2020012163 | A1 | 1/2020 |

OTHER PUBLICATIONS

Prudent, M , et al., "The role of copper in cysteine oxidation: study of intra- and inter-molecular reactions in mass spectrometry", Metallomics, 1(2):157-165, Dec. 24, 2008.

Wikipedia, "Post-transition metal", pp. 1-10, Aug. 26, 2019, Retrieved from the Internet:URL:https://en.wikipedia.org/wiki/Post-transitionjnetal, [retrieved on Oct. 2, 2019].

Examination Report for GB Application No. GB1909613.0, dated Oct. 20, 2020.

Combined Search and Examination Report for GB Application No. GB1909613.0, dated Jan. 6, 2020.

Search Report for GB Application No. GB1811383.7, dated Feb. 21, 2019.

* cited by examiner

IMPACT IONISATION ION SOURCE

CROSS-REFERENCE TO RELATED APPLICATIONS

This application is a U.S. national phase filing claiming the benefit of and priority to International Patent Application No. PCT/GB2019/051891, filed Jul. 4, 2019, which claims priority from and the benefit of United Kingdom patent application No. 1811383.7 filed on Jul. 11, 2018. The entire contents of these applications are incorporated herein by reference.

FIELD OF THE INVENTION

The present invention relates generally to mass spectrometers and methods of mass spectrometry and in particular to methods of analysing biomolecules using mass spectrometry. Various preferred embodiments relate to both an Electrospray-impact ionisation ion source and an impact ionisation ion source.

BACKGROUND

The analysis of a biomolecule species by mass spectrometry can result in the formation of common salt adduct ions such as $[M+Na]^+$ or $[M+K]^+$. The formation of such salt adduct ions can reduce the sensitivity of mass spectral analyses since the adduct ions compete for charge with the desired protonated ions $[M+H]^+$. In the case of multiply charged large biomolecules, excessive adducting can reduce the accuracy of mass measurement and increase the need for high instrument resolution and a concomitant decrease in ion transmission.

It is known to attempt to reduce the tendency of salt ion adducts to form by the appropriate use of additives such as formic acid, ammonia or ammonium formate in the sample solution, or in the mobile phase in the case of chromatographic separation prior to mass spectrometry analysis.

However, such an approach is relatively complex and time consuming.

In the case of large biomolecules, such as proteins in blood or plasma, it is known to use direct sample preparation methods such as spin desalting columns or size exclusion chromatography ("SEC") in order to reduce the salt content and hence improve the mass spectral quality.

However, again such sample preparation techniques are problematic in that they are comparatively complex and increase the overall cost and time of the analytical method.

These preparation techniques are therefore considered to be undesirable.

It is desired to provide an improved method of mass spectrometry and to be able to analyse large biomolecules without needing to resort to complex and time consuming pre-analysis sample preparation techniques.

SUMMARY

According to an aspect of the present invention there is provided an ion source comprising:

a nebuliser or electrospray probe for nebulising a sample; and an impact surface or target electrode, wherein the impact surface or target electrode comprises a tarnishable or oxidisable metal or an alloy comprising a tarnishable or oxidisable metal.

According to various embodiments an impact ionisation ion source and an impact ionisation method are disclosed comprising using a tarnishable or oxidisable metal, such as indium, as an impact surface or target electrode.

An impact ionisation ion source according to various embodiments is particularly beneficial in that the ion source is effective at either displacing common salt adducts and/or forming multiply-adducted biomolecule ions, such as multiply-adducted protein ions, for the study of, for example, ion conformations, ion-molecule reactions and ion-ion reactions or interactions.

Various embodiments relate to various methods of ionising a sample by directing a nebulised sample on to an impact surface comprising a tarnishable or oxidisable metal such as indium. The various embodiments relate to an impact surface-type ionisation source which is effective to displace common salt adducts.

In contrast to conventional methods, the various disclosed embodiments are particularly beneficial in that they enable biomolecules to be readily analysed without the excessive formation of common salt adduct ions such as $[M+Na]^+$ or $[M+K]^+$ by displacing the common salt adducts via a quick and simple process. The approach according to various embodiments avoids the conventional need to use direct sample preparation methods such as spin desalting columns or size exclusion chromatography ("SEC").

It will be understood, therefore, by those skilled in the art that the ability to use an impact surface-type ionisation ion source in the manner as disclosed herein to quickly and simply analyse biomolecules without the excessive formation of undesirable common salt adducts, coupled with the ability to form desirable multiply-adducted protein ions for the study of various properties of the proteins represents a significant advance in the art.

The tarnishable or oxidisable metal or alloy may comprise a tarnishable or oxidisable metal having an electronegativity>1.50.

The tarnishable or oxidisable metal or alloy may comprise a tarnishable or oxidisable metal having a melting point<1500 K, <1450 K, <1400 K, <1350 K, <1300 K, <1250 K, <1200 K, <1150 K, <1100 K, <1050 K or <1000K.

The tarnishable or oxidisable metal or alloy may comprise a tarnishable or oxidisable metal having a melting point>400 K, >410 K, >420 K, >430 K, >440 K, >450 K, >460 K, >470 K, >480 K, >490 K or >500 K.

The tarnishable or oxidisable metal or alloy may comprise a tarnishable or oxidisable metal having a hardness<2.0 Mohs.

The tarnishable or oxidisable metal or alloy may comprise a tarnishable or oxidisable metal which comprises a post-transition metal such as gallium (Ga), indium (In), tin (Sn), lead (Pb) or bismuth (Bi).

In particular, the tarnishable or oxidisable metal or alloy comprising a tarnishable or oxidisable metal may comprise indium (In).

Alternatively, the tarnishable or oxidisable metal or alloy comprising a tarnishable or oxidisable metal may comprise copper (Cu) or aluminium (Al).

According to other embodiments the tarnishable or oxidisable metal or alloy comprising a tarnishable or oxidisable metal may comprise germanium (Ge), antimony (Sb), zinc (Zn), cadmium (Cd), magnesium (Mg), silver (Ag), titanium (Ti), tantalum (Ta) or tungsten (W).

To the extent that any of these metals may not be considered to be tarnishable or easily oxidisable then according to another aspect of the present invention there is provided an ion source comprising:

a nebuliser or electrospray probe for nebulising a sample; and an impact surface or target electrode, wherein the impact surface or target electrode comprises a metal or an alloy comprising gallium (Ga), indium (In), tin (Sn), lead (Pb), bismuth (Bi), copper (Cu), aluminium (Al), germanium (Ge), antimony (Sb), zinc (Zn), cadmium (Cd), magnesium (Mg), silver (Ag), titanium (Ti), tantalum (Ta) or tungsten (W).

The impact surface or target electrode preferably comprises a metal other than a non-corrosive metal or alloy such as stainless steel.

A conventional impact surface or target electrode comprising exclusively of stainless steel should not be considered as falling within the scope of the present invention.

However, a stainless steel substrate having an outer coating or surface comprising a metal or an alloy such as gallium (Ga), indium (In), tin (Sn), lead (Pb), bismuth (Bi), copper (Cu), aluminium (Al), germanium (Ge), antimony (Sb), zinc (Zn), cadmium (Cd), magnesium (Mg), silver (Ag), titanium (Ti), tantalum (Ta) or tungsten (W) should be considered as falling within the scope of the present invention.

The impact surface or target electrode may be arranged downstream of the nebuliser or electrospray probe wherein, in use, a stream of uncharged droplets or charged droplets is directed so as to impact upon the impact surface or target electrode so as to form a plurality of analyte ions or secondary ions.

The impact surface or target electrode may be maintained either at: (i) ground or 0V; (ii) a positive potential; or (iii) a negative potential.

The ion source may further comprise a device for adding helium gas to a nebuliser gas which is emitted, in use, by the nebuliser or electrospray probe and/or for otherwise supplying helium gas in the vicinity of the impact surface or target electrode.

The impact surface or target electrode may comprise one or more spike features or projections in order to enhance an electric field in the vicinity of the impact surface or target electrode.

According to another aspect of the present invention there is provided a Central Wire Electrospray ionisation ("CWESI") ion source comprising:

a nebuliser or electrospray probe for nebulising a sample, wherein the nebuliser or electrospray probe further comprises a central wire, wherein the central wire comprises a tarnishable or oxidisable metal or an alloy comprising a tarnishable or oxidisable metal.

In particular, embodiments are contemplated wherein the central wire may comprise a metal or an alloy such as gallium (Ga), indium (In), tin (Sn), lead (Pb), bismuth (Bi), copper (Cu), aluminium (Al), germanium (Ge), antimony (Sb), zinc (Zn), cadmium (Cd), magnesium (Mg), silver (Ag), titanium (Ti), tantalum (Ta) or tungsten (W).

The Central Wire Electrospray ionisation ("CWESI") ion source comprising a central wire comprising a tarnishable or oxidisable metal or an alloy comprising a tarnishable or oxidisable metal may be provided in conjunction with a downstream impact surface or target electrode. The impact surface or target electrode may comprise a conventional stainless steel impact surface or target electrode. However, according to other embodiments the impact surface or target electrode may comprise a tarnishable or oxidisable metal or an alloy comprising a tarnishable or oxidisable metal. According to other embodiments the Central Wire Electrospray ionisation ("CWESI") ion source may comprise a Gap Electrospray ion source.

According to another aspect there is provided a mass spectrometer comprising an ion source as described above.

The mass spectrometer may comprise an atmospheric pressure interface and the ion source may be arranged upstream of the atmospheric pressure interface.

According to another aspect there is provided a method of ionising a sample comprising:

nebulising a sample; and directing the nebulised sample on to an impact surface or target electrode, wherein the impact surface or target electrode comprises a tarnishable or oxidisable metal or an alloy comprising a tarnishable or oxidisable metal.

The tarnishable or oxidisable metal may comprise either gallium (Ga), indium (In), tin (Sn), lead (Pb), bismuth (Bi), copper (Cu), aluminium (Al), germanium (Ge), antimony (Sb), zinc (Zn), cadmium (Cd), magnesium (Mg), silver (Ag), titanium (Ti), tantalum (Ta) or tungsten (W).

To the extent that any of these metals may not be considered to be tarnishable or easily oxidisable then according to another aspect of the present invention there is provided a method of ionising a sample comprising:

nebulising a sample; and directing the nebulised sample on to an impact surface or target electrode, wherein the impact surface or target electrode comprises a metal or an alloy comprising gallium (Ga), indium (In), tin (Sn), lead (Pb), bismuth (Bi), copper (Cu), aluminium (Al), germanium (Ge), antimony (Sb), zinc (Zn), cadmium (Cd), magnesium (Mg), silver (Ag), titanium (Ti), tantalum (Ta) or tungsten (W).

According to another aspect there is provided a method of ionising a sample comprising:

adding a post-transition metal salt to a sample prior to nebulising the sample;

nebulising the sample; and directing the nebulised sample on to an impact surface or target electrode in order to generate analyte or secondary ions.

The post-transition metal may comprise gallium (Ga), indium (In), tin (Sn), lead (Pb) or bismuth (Bi).

According to another aspect there is provided a method of ionising a sample comprising:

nebulising a sample using a Central Wire Electrospray ionisation ("CWESI") ion source having a central wire comprising a tarnishable or oxidisable metal or an alloy comprising a tarnishable or oxidisable metal.

According to various embodiments the central wire may comprise a metal or an alloy comprising gallium (Ga), indium (In), tin (Sn), lead (Pb), bismuth (Bi), copper (Cu), aluminium (Al), germanium (Ge), antimony (Sb), zinc (Zn), cadmium (Cd), magnesium (Mg), silver (Ag), titanium (Ti), tantalum (Ta) or tungsten (W).

According to another aspect there is provided a method of performing Electron Transfer Dissociation ("ETD) comprising using gallium (Ga), indium (In), tin (Sn), lead (Pb), bismuth (Bi), copper (Cu), aluminium (Al), germanium (Ge), antimony (Sb), zinc (Zn), cadmium (Cd), magnesium (Mg), silver (Ag), titanium (Ti), tantalum (Ta) or tungsten (W) incorporated analyte ions that receive electrons from reagent ions in order to cause the analyte to fragment and generate fragment ions.

According to another aspect there is provided a method of mass spectrometry comprising a method as discussed above.

According to another aspect there is provided a method of desalting a sample comprising using a tarnishable metal to displace salt adducts.

According to another aspect there is provided a method of separating conformer ions comprising ionising a sample using an Electrospray-impact ionisation ion source, an impact ionisation ion source or a Central Wire Electrospray Ionisation ("CWESI") ion source having a target or central wire comprising a tarnishable metal and then optionally separating the ions according to their ion mobility.

According to another aspect there is provided a method of identifying ions comprising ionising a sample using an Electrospray-impact ionisation ion source, an impact ionisation ion source or a Central Wire Electrospray Ionisation ("CWESI") ion source having a target or central wire comprising a tarnishable metal, optionally fragmenting the ions using Electron Transfer Dissociation ("ETD") or Electron Capture Dissociation ("ECD") and then optionally analysing or mass analysing the resultant fragment ions.

BRIEF DESCRIPTION OF THE DRAWINGS

Various embodiments will now be described, by way of example only, and with reference to the accompanying drawings in which.

DETAILED DESCRIPTION

Various embodiments will now be described in more detail below which relate to various methods of ionising a sample by directing a nebulised sample on to an impact surface comprising a tarnishable or oxidisable metal such as indium. The various embodiments relate to an impact surface-type ionisation source which is effective to displace common salt adducts.

In contrast to conventional methods, the various disclosed embodiments are particularly beneficial in that they enable biomolecules to be readily analysed without the excessive formation of common salt adduct ions such as $[M+Na]^+$ or $[M+K]^+$ by displacing the common salt adducts via a quick and simple process. The approach according to various embodiments avoids the conventional need to use direct sample preparation methods such as spin desalting columns or size exclusion chromatography ("SEC").

It will be understood, therefore, by those skilled in the art that the ability to use an impact surface-type ionisation ion source in the manner as disclosed herein to quickly and simply analyse biomolecules without the excessive formation of undesirable common salt adducts, coupled with the ability to form desirable multiply-adducted protein ions for the study of various properties of the proteins represents a significant advance in the art.

Figure 1:
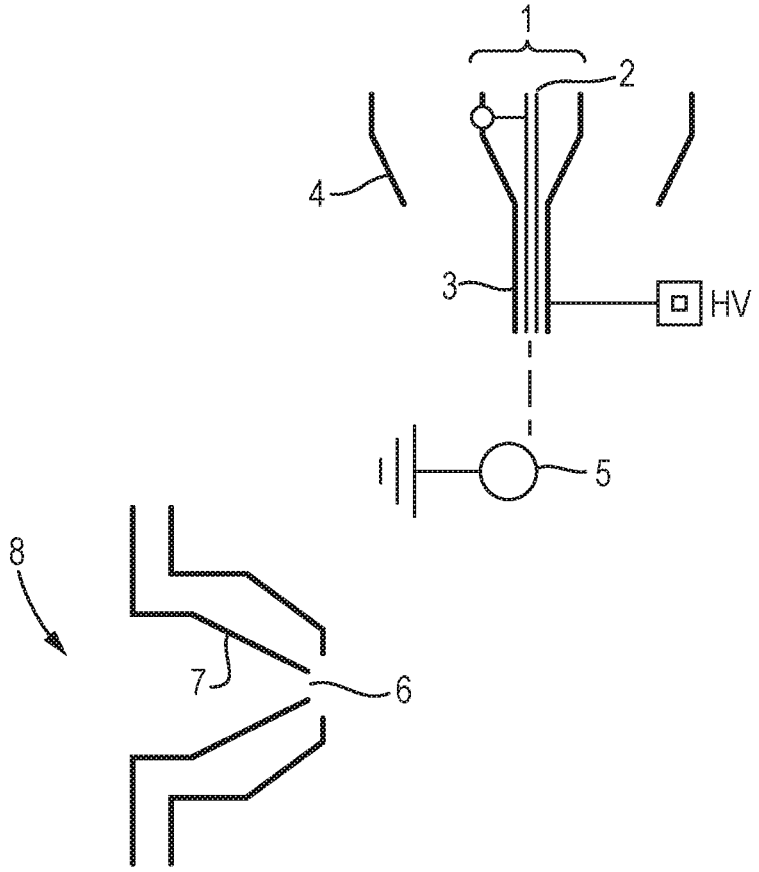
FIG. 1 shows an Electrospray-impact ionisation ion source comprising an Electrospray ionisation probe and a grounded cylindrical impact surface target.

Analysis of Bovine Insulin by Electrospray-Impact Surface Ionisation Ion Sources FIG. 1 shows a schematic of an Electrospray-impact ionisation ("ESI") ion source that may be used according to various embodiments for the ionisation of biomolecules or other samples. The Electrospray-impact ionisation ion source may comprise a pneumatically-assisted electrospray ionisation probe 1 and a grounded cylindrical (or other shaped) impact surface target 5.

The impact surface target 5 may variously be referred to as comprising an impact surface target, a target, a target electrode or an impact surface. The impact surface target 5 is preferably metallic or at least has a metallic coating or outer surface.

The probe 1 may be formed from an inner stainless steel liquid capillary 2 and an outer concentric stainless steel gas capillary 3. In one arrangement the inner stainless steel liquid capillary 2 may have an inner diameter of e.g. 130 μm and an outer diameter of e.g. 220 μm. However, it will be understood that the inner capillary 2 may have a different inner diameter and/or a different outer diameter.

The outer stainless steel gas capillary 3 may have an inner diameter of 330 μm and an outer diameter of 440 μm. However, it will be understood that the outer capillary 3 may have a different inner diameter and/or a different outer diameter.

A solution containing a biomolecular sample may be passed through the probe 1 at a flow rate within, for example, the range 0.005-1 mL/min.

The gas capillary inlet may be pressured to a pressure of about 7 bar so as to create a high velocity jet with a gas flow rate that may be, for example, around 120 L/hr at the probe exit. This gas flow aids nebulisation of the liquid flow.

In order to aid charging of the spray plume, the inner capillary 2 and the outer capillary 3 may be electrically connected and may be held at a potential with respect to the ion inlet cone 7 of a mass spectrometer. According to an embodiment the potential may be +4 kV for positive ion analysis. However, it will be understood that the inner capillary 2 and/or the outer capillary 3 may be held at a different potential with respect to the ion inlet cone 7.

Desolvation of the spray plume may be aided by a concentric flow of hot nitrogen gas (or other gas) provided from a desolvation heater 4 as shown in FIG. 1.

The nitrogen (or other gas) may be heated to a temperature of 70-350° C. by the desolvation heater 4. The desolvation gas (e.g. nitrogen) may be provided at a flow rate of e.g. 1000 L/hr. However, it will be understood that the desolvation gas may be provided at a different flow rate.

According to various embodiments the impact surface target 5 may comprise an indium impact surface or target or more generally a tarnishable or oxidisable metal or alloy.

According to various embodiments an indium (or other metal or alloy) impact surface may be provided and the gas temperature may be maintained below approximately 150° C. in order to avoid melting of the indium (or other metal or alloy). However, other embodiments are contemplated wherein the indium (or other metal or alloy) may be provided in the form of an alloy or matrix having a higher melting temperature and hence embodiments are contemplated wherein the desolvation gas may be provided at a temperature higher than 150° C.

Ions created by the Electrospray-impact ionisation ion source may be sampled into the mass spectrometer through the ion inlet orifice 6 which may be 0.4-0.8 mm in diameter. The inlet orifice 6 may create a boundary between the atmospheric pressure region of the source and a first vacuum region 8 of the mass spectrometer.

As shown in FIG. 1, a high velocity electrospray plume may be arranged to impact upon the upper right-hand quadrant of a cylindrical grounded impact surface target 5. It will be understood that it is not essential that the target 5 is cylindrical and that according to other embodiments the target 5 may take other forms.

The impact surface target 5 may comprise a metallic or part-metallic impact surface. The target 5 may have a diameter of e.g. 1.6 mm and a length of e.g. 35 mm. However, other embodiments are contemplated wherein the target 5 may have a different diameter and/or a different length.

According to various embodiments an off-axis arrangement is provided such that the gas flow becomes attached to the curved surface of the target 5 and the wake flow is directed towards the ion inlet orifice 6.

The target 5 may be positioned e.g. 5 mm in front of the ion inlet orifice 6. The target may be positioned e.g. 10 mm above the ion inlet orifice 6 of the mass spectrometer.

According to various embodiments the probe position can be critically adjusted in the x and y directions (i.e. in the plane of the page).

The source may be surrounded by an air tight enclosure (not shown) that includes an exhaust outlet to vent the atmospheric-pressure gases and vapour.

According to various embodiments an Electrospray-impact ionisation ion source may be used to obtain enhanced structural information of biomolecules such as monoclonal antibodies ("mAbs") and insulin by the in-source reduction of disulphide bonds. In particular, using an impact surface target 5 other than stainless steel may be beneficial for the analysis of biomolecules such as monoclonal antibodies ("mAbs") and insulin.

For example, according to various embodiments the target 5 may comprise aluminium which has been found to be beneficial for the analysis of monoclonal antibodies ("mAbs") and insulin.

According to other embodiments the impact surface or target 5 may comprise indium or another tarnishable or easily oxidisable metal or metal alloy. In particular, providing an impact surface or target 5 formed of or comprising indium has been found to be beneficial in terms of removing certain adduct ions such as $Na^+$ and $K^+$ adduct ions. In particular, the use of an indium target 5 has been found to be beneficial when seeking to ionise biomolecules.

One significant benefit of using an indium (or other tarnishable or easily oxidisable) target 5 is that it avoids a user needing to resort to relatively time-consuming, complex and costly sample preparation methods.

Bovine insulin (MW=5729.61 Da) is a two-chain polypeptide hormone where the A and B chains are connected via two disulphide bonds.

According to various embodiments an Electrospray-impact ionisation ion source having an indium impact surface was used to analyse a bovine insulin solution. A 5 pmol/μL bovine insulin solution was prepared in 1:1 methanol:water with 1% acetic acid. This solution was infused at 10 μl/min into a 0.4 mL/min make-up flow of 1:1 acetonitrile:water containing 0.1% formic acid and the resulting flow was introduced into an Electrospray-impact ionisation ion source for analysis by a Time of Flight mass analyser.

The solution was greater than one year old and was selected since it could be expected to yield highly adducted sample ions.

The analysis was then repeated with an aluminium impact surface 5 instead of an indium impact surface 5.

Figure 2A:
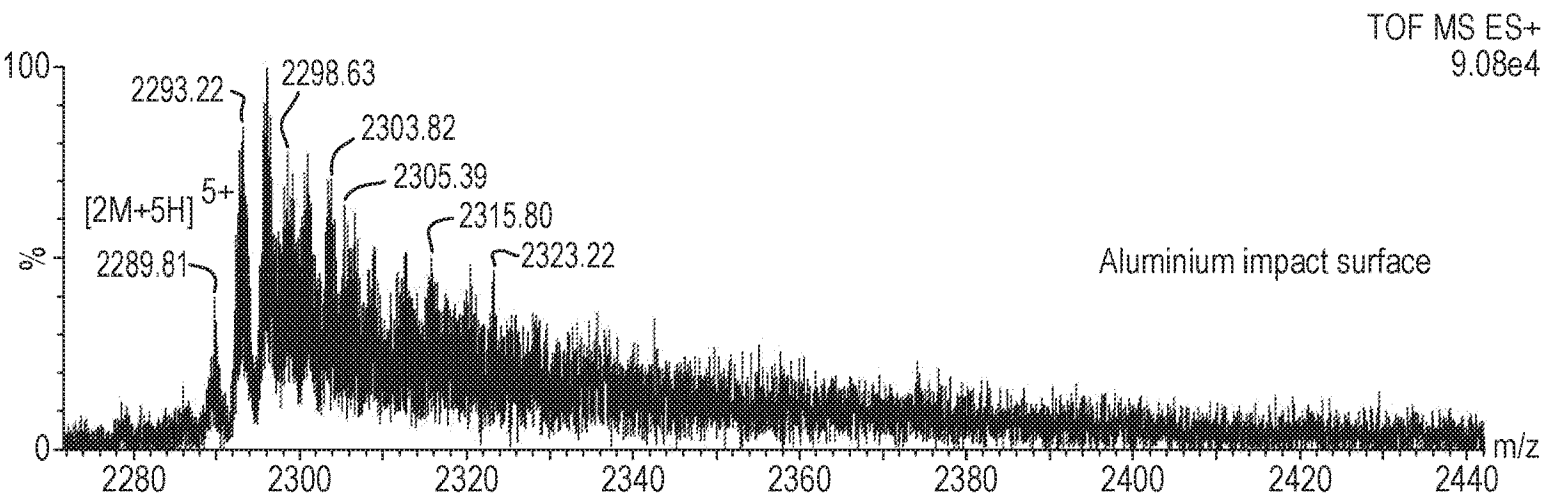
FIG. 2A shows a mass spectrum obtained using an Electrospray-impact ionisation ion source comprising an aluminium impact surface to ionise a bovine insulin sample and FIG. 2B shows a corresponding mass spectrum obtained according to various embodiments using an Electrospray-impact ionisation ion source having an indium impact surface to ionise the bovine insulin sample.
Figure 2B:
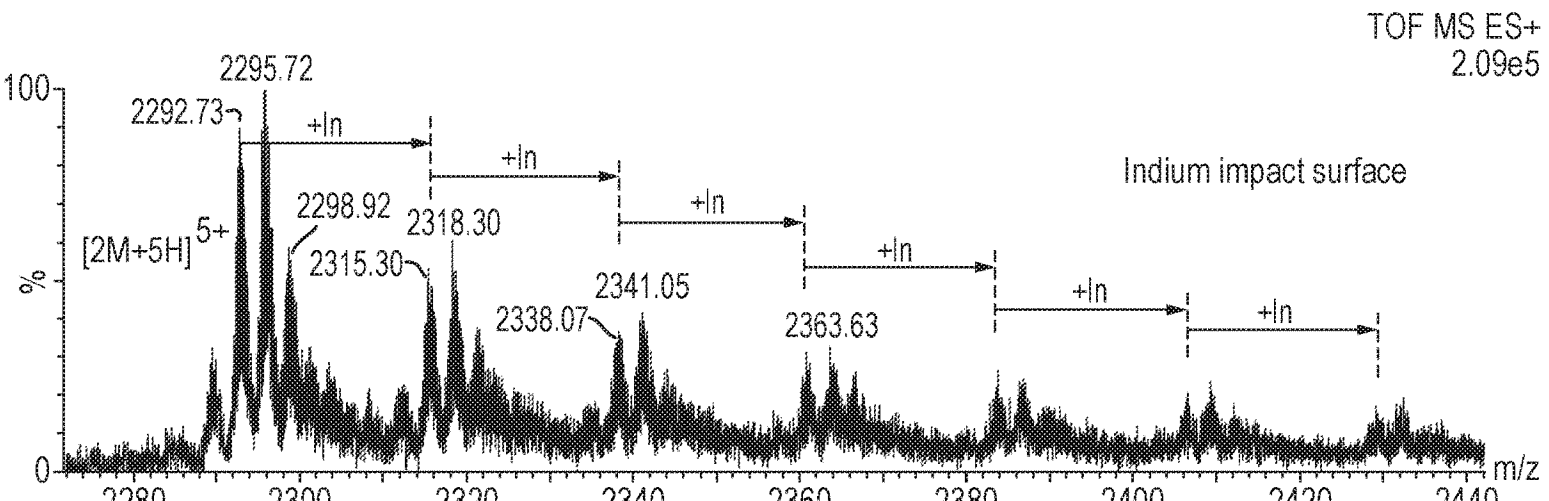

FIG. 2A shows a mass spectrum obtained from analysing the sample using an aluminium impact surface target 5 and FIG. 2B shows a corresponding mass spectrum obtained using an indium impact surface 5. In both cases, the mass spectra relate to the insulin dimer $[2M+5H]^{5+}$ ion.

It is apparent from FIG. 2A that a highly adducted ion is obtained using an aluminium impact surface.

In contrast, it is apparent from FIG. 2B that using an indium impact surface according to various embodiments of the present invention results in the formation of multiple indium adduct ions with the $[2M+5H]^{5+}$ ion wherein the adducts also have a charge state of 5+. The bovine insulin monomer ions also forms the same series of adduct ions where as many as 11 adducts are obtained (data not fully shown).

Since the number of adducts exceeds the charge state of the ions shown in FIG. 2B, it is believed that indium can adduct via both ion exchange with protons and by charge neutral association of an indium cation with, for example, a deprotonated carboxylic group.

Alternatively, indium may be incorporated into proteins via deprotonation of an amide linkage and chelation of the metal ion.

Figure 3A:
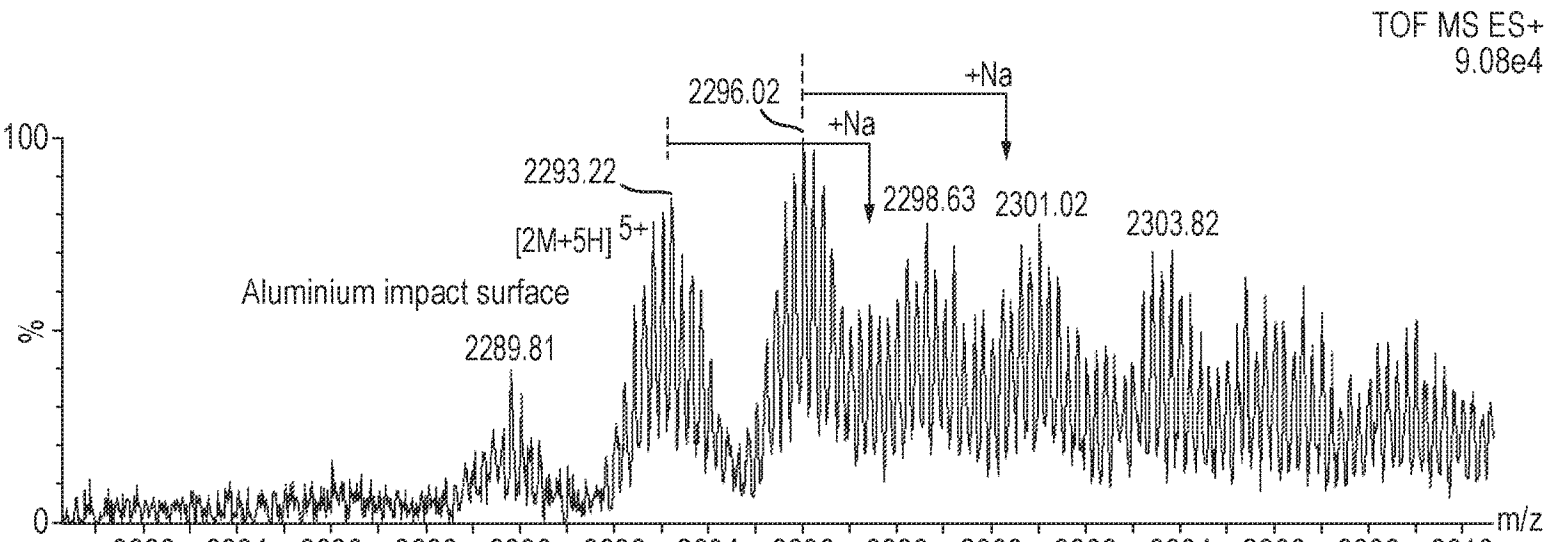
FIG. 3A shows a zoomed view of a portion of the mass spectrum shown in FIG. 2A
Figure 3B:
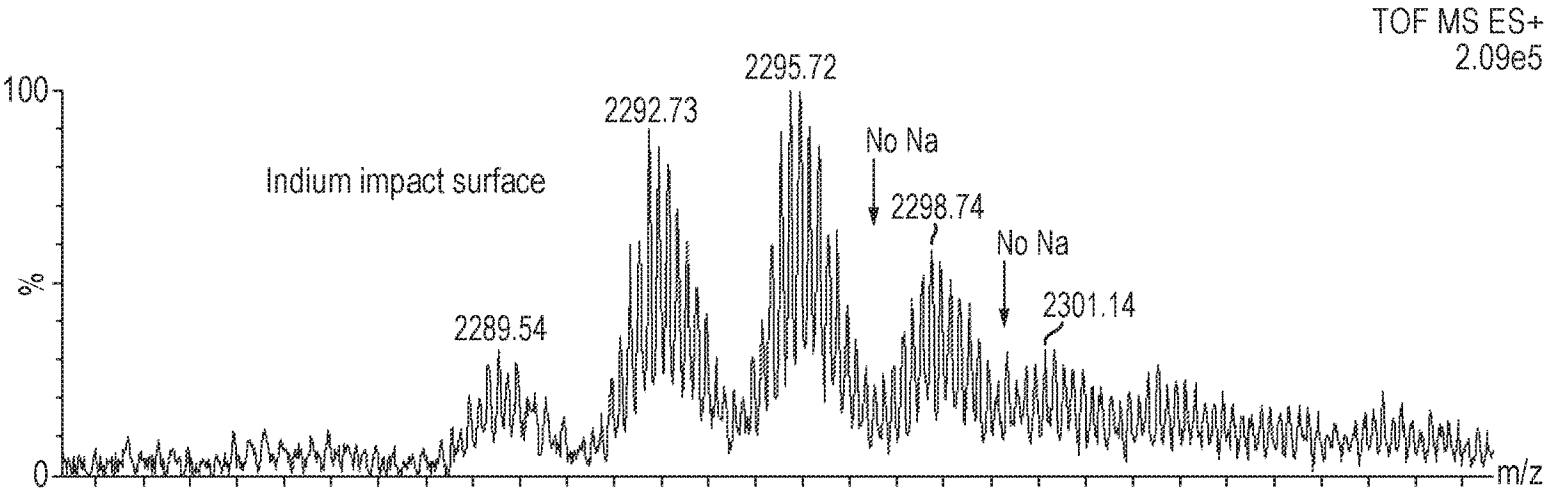
FIG. 3B shows a zoomed view of a portion of the mass spectrum shown in FIG. 2B.

FIGS. 3A and 3B show a zoomed view of a portion of the mass spectra shown in FIG. 2A and FIG. 2B respectively.

FIG. 3A shows that the aluminium impact surface may form sodiated adducts ($Na^+$) that lie between the major ion peaks of the dimer where the major peaks are believed to include oxidized products of the dimer. However, significantly, FIG. 3B shows that the $Na^+$ adducts are not present when, in accordance with various embodiments, an indium impact surface is used.

It will be apparent, therefore, that the use of an indium target according to various embodiments leads to significantly improved spectral quality.

Accordingly, the method according to various embodiments enables a process of preferentially replacing common ion adducts such as $Na^+$ and $K^+$ with larger indium adducts which results in simplified multiply-charged mass spectra of biomolecules that are easier to interpret. The resulting mass spectra have a significantly improved spectral quality and can be obtained without requiring relatively time-consuming, complex and costly sample preparation methods such as such as spin desalting columns or size exclusion chromatography ("SEC").

A particular benefit of the various embodiments is that simplified multiply-charged mass spectra of biomolecules can be obtained that are easier to interpret and of a significantly improved spectral quality which may be readily obtained in a quick and simple manner.

As will be discussed in more detail below, the aforementioned benefits and advantages of the use of an indium impact surface are also provided by an impact surface comprising other tarnishable or oxidisable metals.

Analysis of Antibodies ("mAbs") by a Act Ionisation Ion Sources

The formation of common salt adducts in the mass spectral analysis of monoclonal antibodies ("mAbs") can degrade spectral quality and hence accuracy of the assay. Monoclonal antibodies are complex recombinant proteins with a molecular weight of ~150,000 Da and it is known to use them as therapeutics for many diseases.

It is known, for example, to analyse monoclonal antibody samples using a reverse phase, gradient-elution, stepped flow rate ultra-high performance liquid chromatography ("UHPLC") separation.

Various analyses of the monoclonal antibody Trastuzumab were performed using a reverse phase gradient comprising water and acetonitrile wherein both mobile phases contained 0.1% formic acid. The chromatographic flow rate was varied from 0.5 mL/min (0-0.5 min) to 0.2 mL/min (0.5-2.0 min) and back to 0.5 mL/min (2.0-4.5 min). Samples were injected onto a C4 column that was appropriate for large proteins (WATERS® Protein BEH C4, 300 Å, 1.7 μm, 2.1 mm×50 mm).

A Trastuzumab monoclonal antibody standard was prepared at a concentration of 1 mg/mL in water and a 2 μL sample was injected onto the column. The eluting sample was then analysed with an Electrospray-impact ionisation ion source in combination with an orthogonal acceleration Time of Flight mass analyser.

Figure 4:
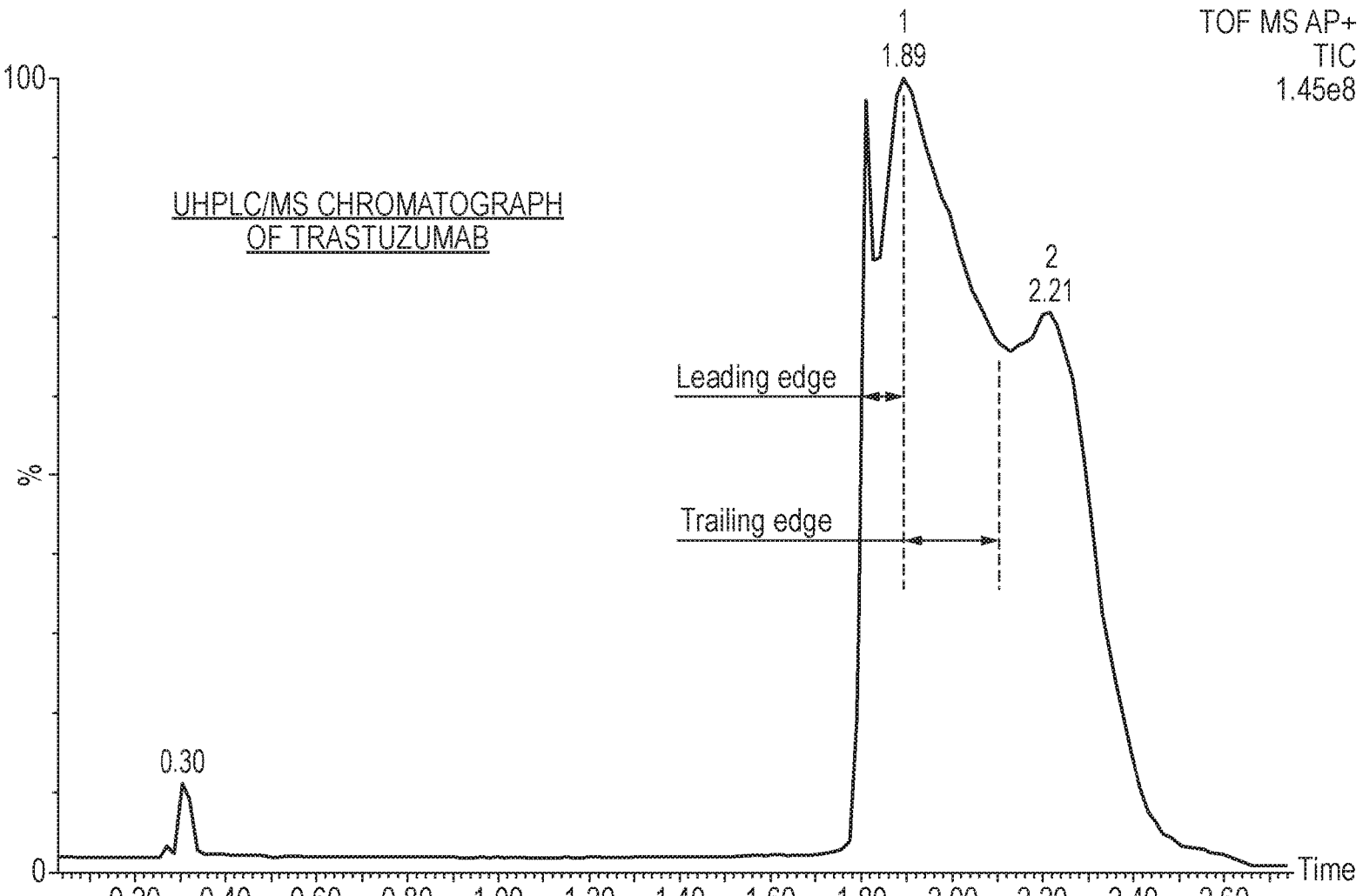
FIG. 4 shows a chromatograph of a Trastuzumab monoclonal antibody sample.

Under these experimental conditions, Trastuzumab elutes over two relatively broad chromatographic peaks as shown in FIG. 4 as peaks 1 and 2.

Regardless of the ionisation method, the leading edge of peak 1 can be analysed to obtain the best mass spectral quality whilst the trailing edge of peak 1 gives poorer mass spectra with increased adduct ion formation.

Peak 2 is potentially prone to severe adducting which results in the lowest quality mass spectra.

Figure 5A:
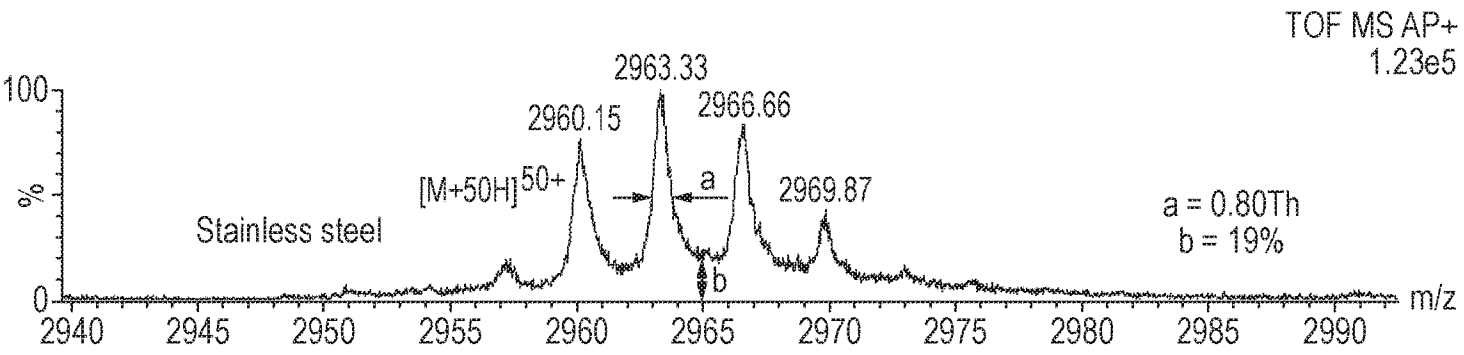
FIG. 5A shows a mass spectrum obtained using an Electrospray-impact ionisation ion source having a stainless steel impact surface and corresponds to the leading edge of peak 1 as shown in FIG. 4.
Figure 5B:
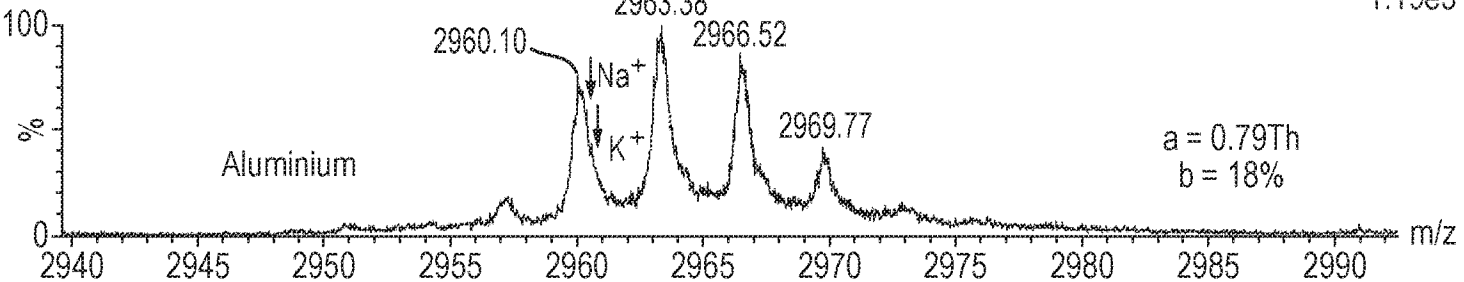
FIG. 5B shows a mass spectrum obtained using an Electrospray-impact ionisation ion source having an aluminium impact surface and corresponds to the leading edge of peak 1 as shown in FIG. 4
Figure 5C:
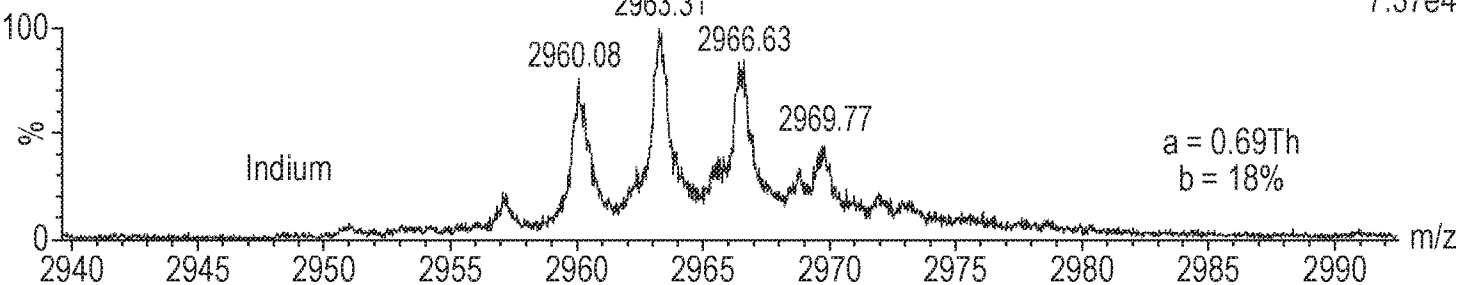
FIG. 5C shows a mass spectrum obtained according to various embodiments using an Electrospray-impact ionisation ion source having an indium impact surface to ionise the leading edge of peak 1 as shown in FIG. 4.

Comparative mass spectral data are shown in FIGS. 5A-5C. FIG. 5A shows a mass spectrum obtained used a stainless steel impact target 5, FIG. 5B shows a mass spectrum obtained using an aluminium target 5 and FIG. 50 shows a mass spectrum obtained using an indium target 5. The mass spectra correspond to the $[M+50H]^{50+}$ ion of Trastuzumab obtained from the analysis of the leading edge of peak 1 by an Electrospray-impact ionisation ion source having different targets 5.

As is apparent from FIGS. 5A-5C, Trastuzumab is composed of five main glycoforms. The spectral quality may be defined with reference to the peak width of the third glycoform at half height (a) and with reference to the height of the valley between the third and fourth glycoforms (b) as indicated in FIG. 5A.

As is apparent from FIGS. 5A-50 all three impact surface materials may be used to obtain good spectral quality from the leading edge of peak 1. However, it is also apparent that the best (lowest) peak width is obtained using an indium impact surface (a=0.69 Th).

The expected position of common salt adducts ($Na^+$ and $K^+$) is shown on FIG. 5B where it is apparent that excessive adducts or multiple adducts would manifest in increased valley heights (b) and increased glycoform peak widths (a).

Figures 6A, 6B, 6C:
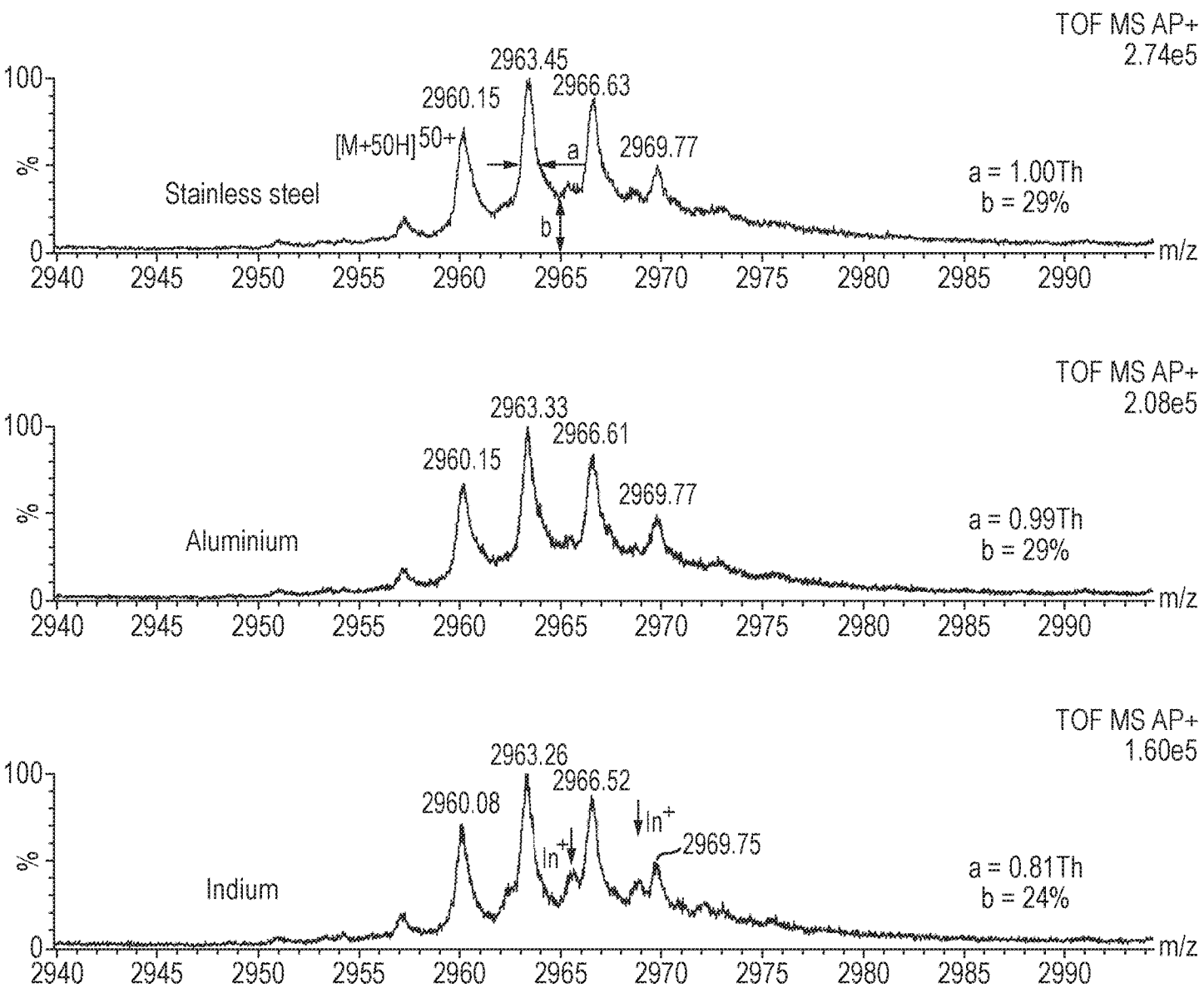
FIG. 6A shows a mass spectrum obtained using an Electrospray-impact ionisation ion source having a stainless steel impact surface to ionise the trailing edge of peak 1 as shown in FIG. 4.
FIG. 6B shows a mass spectrum obtained using an Electrospray-impact ionisation ion source having an aluminium impact surface to ionise the trailing edge of peak 1 as shown in FIG. 4
FIG. 6C shows a mass spectrum obtained according to various embodiments using an Electrospray-impact ionisation ion source having an indium impact surface to ionise the trailing edge of peak 1 as shown in FIG. 4.

FIGS. 6A-6C show corresponding mass spectra obtained from the analysis of the trailing edge of peak 1 by the Electrospray-impact ionisation ion source with a stainless steel impact surface, an aluminium impact surface and an indium impact surface respectively. It is apparent that these data show a marked deterioration in spectral quality in comparison with that obtained from the leading edge of peak 1, as a result of the increased adducting of the trailing edge. Nonetheless, it is apparent that a significantly higher quality spectrum can be obtained from use of the indium impact surface as the mass spectrum obtained with the indium impact surface has the lowest peak width (a) and valley height (b) values.

Figure 7A:
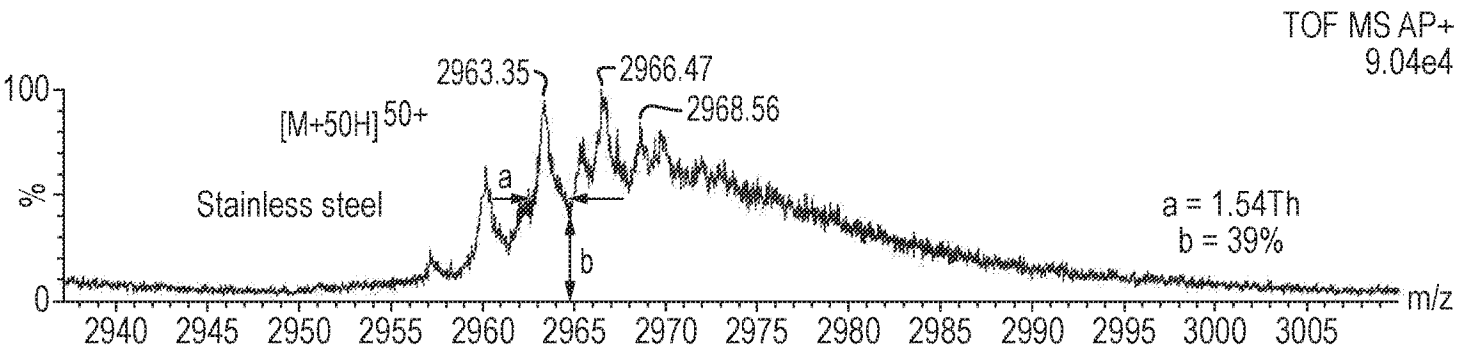
FIG. 7A shows a mass spectrum obtained using an Electrospray-impact ionisation ion source having a stainless steel impact surface to ionise peak 2 as shown in FIG. 4.
Figure 7B:
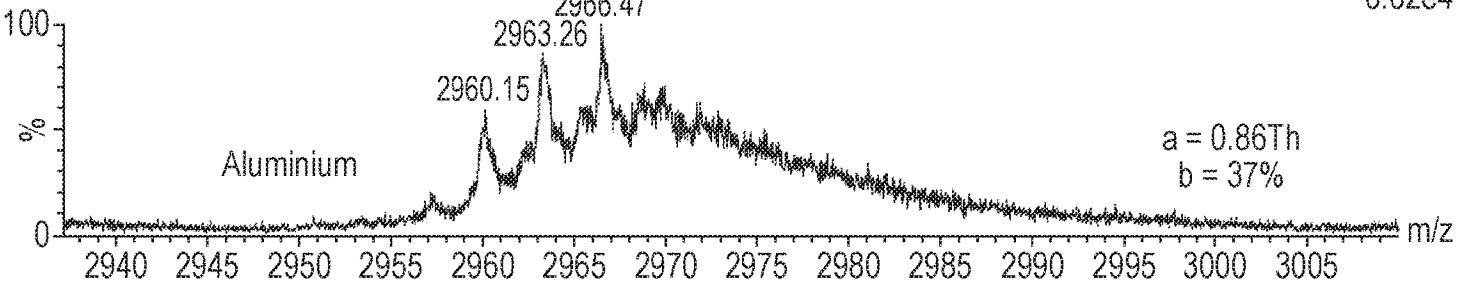
FIG. 7B shows a mass spectrum obtained using an Electrospray-impact ionisation ion source having an aluminium impact surface to ionise peak 2 as shown in FIG. 4
Figure 7C:
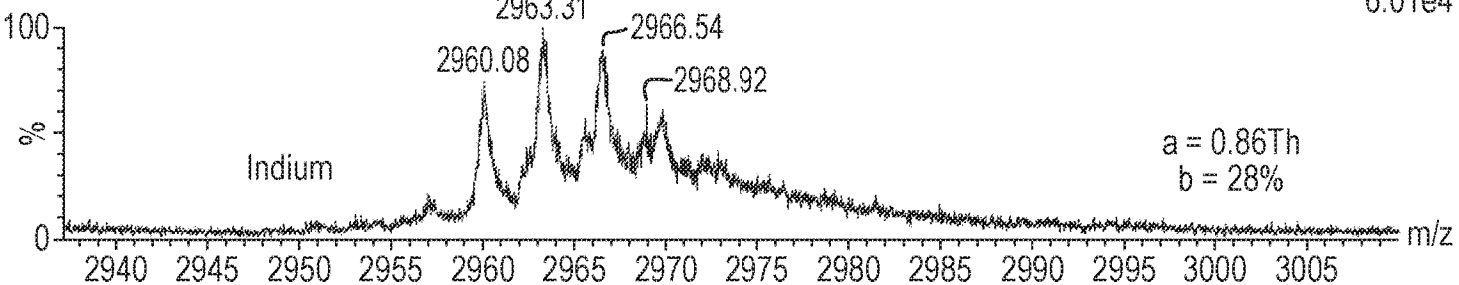
FIG. 7C shows a mass spectrum obtained according to various embodiments using an Electrospray-impact ionisation ion source having an indium impact surface to ionise peak 2 as shown in FIG. 4.

FIGS. 7A-7C show corresponding mass spectra obtained from the analysis of peak 2 by the Electrospray-impact ionisation ion source with a stainless steel, aluminium and indium impact surface or target electrode 5 respectively. As is apparent from FIGS. 7A and 7B, extreme adducting means that the peak width (a) is close to being overwhelmed, or rendered substantially more difficult to resolve, by the increased valley heights (b). However, in the case of the stainless steel impact surface and the aluminium impact surface it is apparent from comparison of FIGS. 7A and 7B with FIG. 7C, that the indium impact surface shows significantly reduced adduct formation and a respectable peak width (a) and valley height (b).

This is a further example of the benefits of using an indium impact surface or target electrode for monoclonal antibody analysis.

As discussed above in relation to the bovine insulin mass spectra shown in FIGS. 2A-2B and FIGS. 3A-3B, it is apparent that the appearance of indium adduct ions, as shown in FIG. 60, for example, indicates that the $In^+$ ions have exchanged with $Na^+$ and $K^+$ ions, and potentially many other adducts, to improve the quality of the mass spectral data of Trastuzumab.

As the atomic mass of indium is 114.82 Da, the adducts formed with the indium conveniently fall between the glycoforms of monoclonal antibodies which are nominally spaced by 162 Da. Furthermore, unlike common salt adducts formed with ions such as $Na^+$ and $K^+$ ions, they are well removed from the trailing edge of the glycoform mass spectral peaks.

Accordingly, the method according to various embodiments enables a process of preferentially replacing ions such as $Na^+$ and $K^+$ ions of common ion adducts with indium adducts which results in mass spectra of biomolecules that are easier to interpret and of a significantly improved spectral quality, without requiring relatively time-consuming, complex, and costly sample preparation methods such as such as spin desalting columns or size exclusion chromatography ("SEC").

The various embodiments therefore are particularly beneficial in that the approach according to various embodiments enables the process of preferentially replacing ions such as $Na^+$ and $K^+$ ions of common ion adducts with e.g. larger indium adducts thereby enabling a biomolecule sample to be easily analysed with an Electrospray-impact ionisation ion source having e.g. an indium impact surface, without requiring relatively time-consuming, complex, and costly sample preparation methods such as such as spin desalting columns or size exclusion chromatography ("SEC").

A particular advantage of the various embodiments is that mass spectra of biomolecules that are easier to interpret and of a significantly improved spectral quality may be readily obtained in a quick and simple manner.

As will be discussed in more detail below, the aforementioned benefits and advantages of the use of the indium impact surface are also provided by an impact surface comprising other tarnishable or easily oxidisable metals or alloys.

Ion Sources Constructed from Tarnishable or Oxidisable Metals

The Electrospray-impact ionisation ion source according to various embodiments as shown in FIG. 1 may according to other embodiments be converted into a conventional impact ionisation ion source by reversing the high voltage bias such that the Electrospray probe 1 is grounded and a high voltage is applied to the impact target 5.

Ultra High Performance Liquid Chromatography Time of Flight mass spectrometry ("UHPLC/TOF-MS") experiments with monoclonal antibodies have shown that the mass spectral characteristics of mass spectra obtained from analysis by a conventional impact ionisation ion source can be affected by the choice of impact surface target material.

In this regard, tarnishable or oxidisable metals such as aluminium or copper have been found to improve the mass spectral quality of mass spectra obtained from conventional impact ionisation ion sources compared with non-corrosive alloys such as stainless steel or Inconel 600 which are commonly used as impact ionisation sources.

Figure 8A:
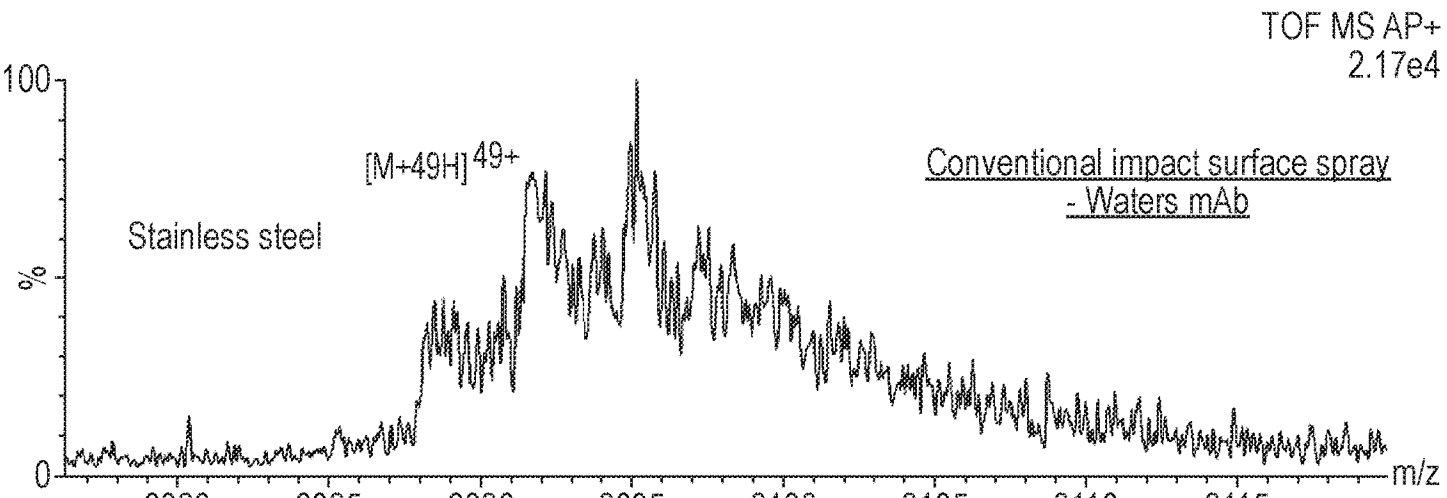
FIG. 8A shows a mass spectrum obtained using an impact ionisation ion source having a stainless steel impact surface to ionise a WATERS® monoclonal antibody ("mAb") sample and FIG. 8B shows a mass spectrum obtained using an impact ionisation ion source having an aluminium impact surface to ionise a WATERS® monoclonal antibody ("mAb") sample.
Figure 8B:
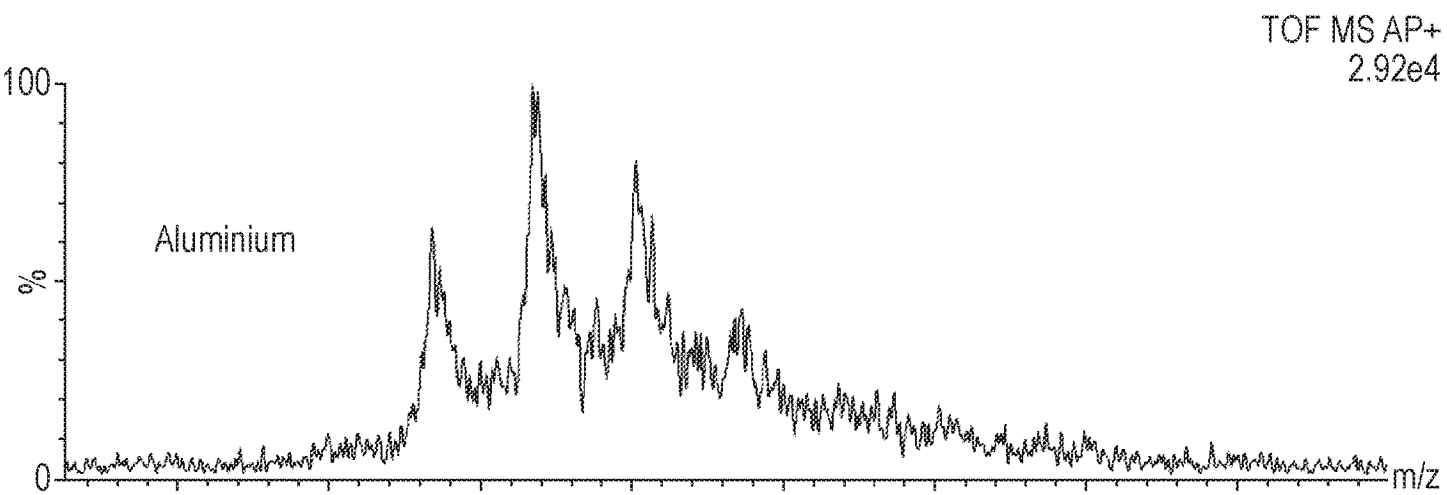

FIGS. 8A and 8B show mass spectra obtained using a sample of monoclonal antibodies using the method described above in relation to Trastuzumab with both a stainless steel impact surface and an aluminium impact surface respectively.

The stainless steel impact surface and the aluminium impact surface were both 1.6 mm in diameter and were biased to a voltage of +4 kV.

As is apparent from a comparison of FIG. 8A with FIG. 8B, significantly reduced adducting occurs with use of an aluminium impact surface when compared to a stainless steel impact surface.

The spectral quality of both FIGS. 8A and 8B were degraded to some extent by the use of excessive argon transfer cell gas that increased the pressure in the Time of Flight mass analyser flight tube. Some improvement was also observed, in comparison to the results obtained with a stainless steel impact surface, by using a copper impact surface (data not shown).

It is apparent from comparison of FIG. 7B with FIG. 8B that an aluminium impact surface is more effective when used in a conventional impact ionisation ion source than when used in an Electrospray-impact ionisation ion source.

The role of discharge currents between the probe and the impact surface is understood to affect the ionisation of large biomolecules in impact surface sources where it is observed that high voltages (e.g. 4-5 kV) are typically required for efficient ionisation as opposed to voltages of only 0.5-1.0 kV for small molecules.

In the case of an Electrospray-impact ionisation ion source, the probe tip (i.e. the liquid capillary 2 as shown in FIG. 1) is known to promote electrolytic reactions as a result of the formation of metal ion radicals which form due to direct electron bombardment of the capillary tip which is positively biased. Reference is made to Lloyd and Hess, JASMS (2009), 20, 1988-1996.

The radicals then react electrolytically with the sample and/or solution components to influence the ionisation.

In the case where aluminium is the preferred material for influencing adduct formation via an electrolytic pathway, then it is preferred for electron bombardment to occur on the aluminium impact surface in the case of a conventional impact surface spray source, i.e. when the aluminium impact surface acts as an anode in the circuit. This is the case for a conventional impact ionisation ion source. This is supported by the data shown in FIGS. 7A-7C and 8A-8B e.g. by a comparison of FIG. 7B with FIG. 8B.

However, in the case of an Electrospray-impact ionisation ion source, the active surface is the capillary tip, the capillary tip being the anode, which is the same stainless steel surface for all the spectra shown in FIGS. 7A-70.

According to a model based on electrolytic reactions when e.g. an indium impact surface is used then indium from the impact surface may be transferred to the active capillary tip in order to influence the ionisation mechanism. This may occur as a result of the transfer of negative oxide ions or negative salt ions which are produced by oxide or acid reactions at the impact surface. Other factors that may favour the transfer of indium material are related to the fact that indium is a particularly malleable metal and has a low melting point of approximately 150° C. which may lead to localised melting/sputtering under discharge conditions.

Various embodiments are contemplated including: (i) an Electrospray ionisation ion source, a Gap Electrospray ionisation ion source and an Electrospray-impact ionisation ion source wherein the liquid capillary is constructed from a tarnishable or oxidisable metal such as indium, aluminium or copper etc.; (ii) a Central Wire Electrospray Ionisation ("CWESI") ion source wherein the central wire is constructed from a tarnishable or oxidisable metal such as indium, aluminium or copper etc.; (iii) an Electrospray-impact ionisation ion source wherein the impact surface target is constructed from a tarnishable or oxidisable metal such as indium, aluminium or copper etc.; and (iv) a conventional impact ionisation ion source wherein the impact surface target is constructed from a tarnishable or oxidisable metal such as indium, aluminium or copper etc.

Accordingly, the ion source according to various different embodiments enables the promotion of electrolytic reactions by the formation of metal ion radicals which may then preferentially replace ions such as $Na^+$ and $K^+$ ions of common biomolecule ion adducts. This can result in mass spectra of biomolecules that are easier to interpret and which have a significantly improved spectral quality. Furthermore, the approach according to various embodiments does not require relatively time-consuming, complex and costly sample preparation methods to be performed such as such as spin desalting columns or size exclusion chromatography ("SEC").

The relatively small and sharp features of an Electrospray capillary tip according to various embodiments result in a localised electric field enhancement at the tip which increases the electron bombardment energy and also increases the localised electron flux due to focusing. The present inventors have found that the addition of helium gas to the tip or impact surface region can increase the discharge current and hence increase the electron flux.

Accordingly, various embodiments are contemplated wherein helium gas is added to, for example, the nitrogen nebulising gas flow. Furthermore, the field enhancing benefits described for an Electrospray capillary tip above may be replicated in a conventional impact ionisation ion source by adding one or more spike features to the upper surface of the impact surface that faces the capillary tip.

Analysis of Indium Adducts

In accordance with various embodiments if an impact ionisation ion source is utilised that comprises an indium impact surface then indium adducts may be observed. The capillary probe may be grounded and the indium target 5 may be held at e.g. +4 kV.

Similarly, in accordance with various embodiments indium adducts may be observed from any of the ionisation or other analysis techniques discussed above by adding a relatively large concentration of an indium (or other) salt to the sample solution in question such as e.g. bovine insulin sample solution.

In order to further characterise the adduction process, analysis was conducted to compare adducts formed from a conventional impact ionisation ion source with an indium impact surface ionisation source according to various embodiments and in relation to adducts obtained from a solution containing an indium salt. For the salt analysis, $InCl_2$ was added to the sample solution and a stainless steel impact surface was used in order to simplify the possible sources of indium adduction. For the indium impact surface analysis, no $InCl_2$ was added to the sample solution.

Figure 9A:
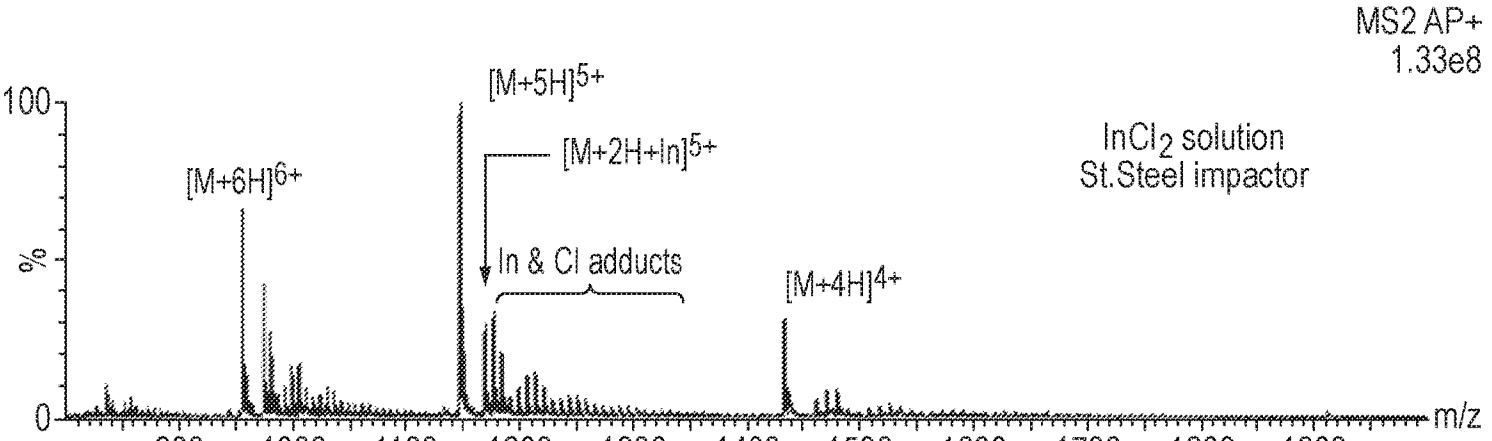
FIG. 9A shows a mass spectrum obtained using an impact ionisation ion source having a stainless steel impact surface to ionise a bovine insulin sample containing $InCl_2$ and FIG. 9B shows a mass spectrum obtained according to various embodiments using an impact ionisation ion source having an indium impact surface to ionise a bovine insulin sample that did not contain any indium salt additive.

The bovine insulin solution described above was diluted by an order of magnitude in either 50/50 methanol/water, for the indium impact surface analysis, or in a 0.5 mM solution of $InCl_2$ (50/50 methanol/water) for the salt analysis. The sample solutions were then individually infused at 10 μL/min into a carrier solvent flow of 0.2 mL/min of 50/50 acetonitrile/water with 0.1% formic acid, FIG. 9A shows a mass spectrum obtained using a triple quadrupole mass spectrometer with an impact ionisation ion source comprising a stainless steel target wherein a bovine insulin solution containing $InCl_2$ was directed on to the stainless steel target. It is apparent that a complex series of indium and chlorine adducts are observed wherein the adducts are qualitatively the same on the 4+, 5+, 6+, and 7+ charge states of bovine insulin.

The same series of adducts were also observed using an Electrospray ionisation ion source and an Electrospray-impact ionisation ion source (data not shown).

Figure 9B:
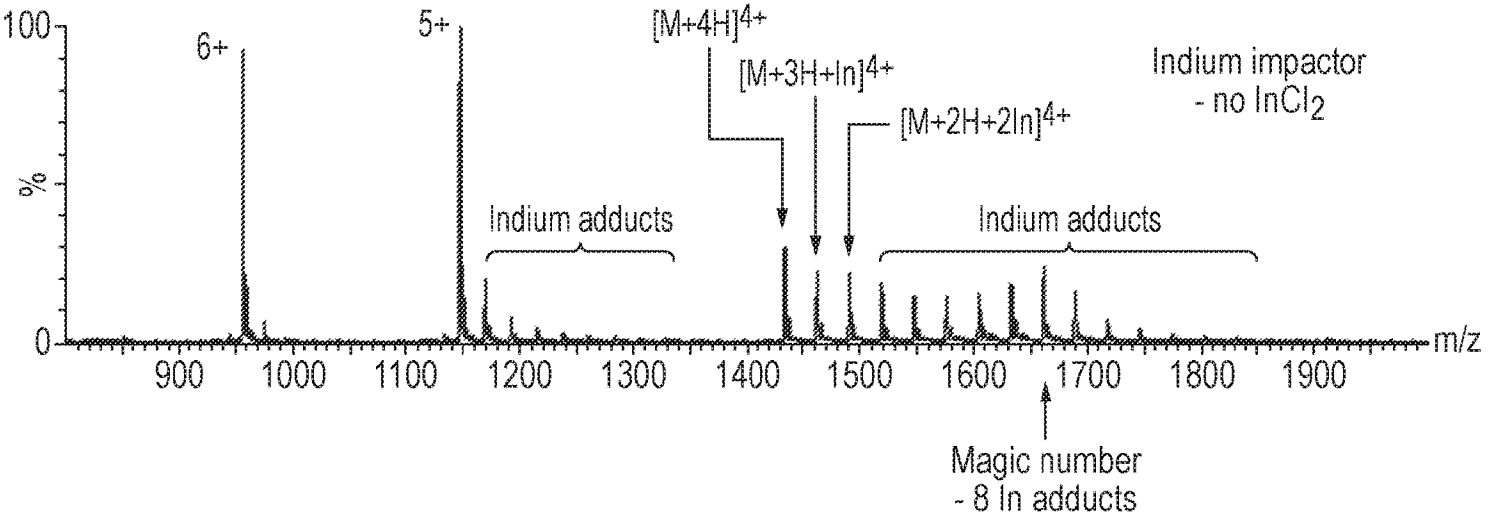

FIG. 9B shows a corresponding mass spectrum of bovine insulin that was obtained according to various embodiments using an indium impact surface ionisation source with a test sample that did not contain any indium salt additive.

It is apparent by comparison of FIG. 9B with FIG. 9A that the indium impact surface is shown to produce a strong series of multiple indium adducts (indium only) wherein as many as 16 indium adducts can be observed in the original data for the 4+ charge state. It is also significant to note that, although the data of FIG. 9B were obtained on a quadrupole mass spectrometer of limited mass resolution and mass accuracy, the indium adduct ions from an indium impact surface appear to incorporate monovalent indium ($In^{1+}$).

FIG. 9B also shows that adducts are only observed on the lower charge states and, furthermore that certain adducts appear more thermodynamically favourable or probable than others. Those that are more favourable or probable may be referred to as having a "magic number".

For example, on the 4+ charge state, eight indium adducts appear to be more thermodynamically favourable.

Accordingly, it may be assumed that the probability of forming indium adducts, and the resulting adduct intensity profiles, are both charge state dependent.

Accordingly, the method according to various embodiments enables various charge states of a biomolecule to be easily and readily observed by the formation of adducts, without requiring complex and time consuming sample preparation steps to be performed such as the addition of salts, wherein the spectral data that may be thereby obtained are easier to interpret and of a significantly improved spectral quality.

A particular advantage of the various embodiments is that mass spectra of biomolecules that are easier to interpret and of a significantly improved spectral quality may be readily obtained in a quick and simple manner.

Central Wire Electrospray Ionisation ("CWESI") Ion Sources

Multiple metal ion adducts were observed with different source materials in both conventional impact ionisation ion sources and Central Wire Electrospray Ionisation ("CWESI") ion sources.

Figure 10:
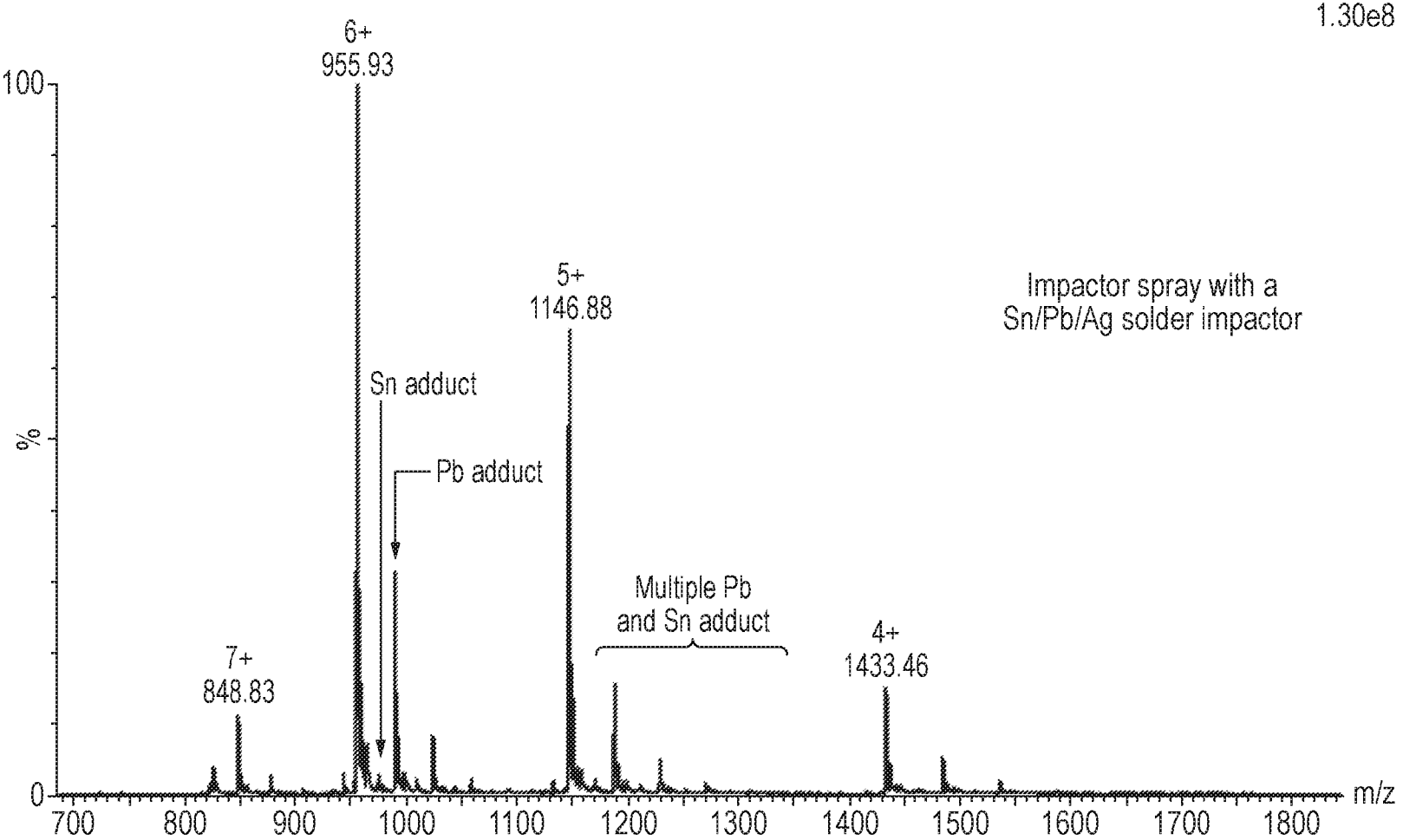
FIG. 10 shows a mass spectrum obtained using an impact ionisation ion source having a tin/lead/silver solder impact surface to ionise a bovine insulin sample.

FIG. 10 shows the metal ion adducts obtained using an impact ionisation ion source having a tin/lead/silver solder impact surface to analyse a bovine insulin sample. The 1.6 mm diameter solder impact surface was composed of 80% lead, 18% tin, and 2% silver.

The mass spectrum shown in FIG. 10 was obtained using a quadrupole mass spectrometer and shows that as many as three lead and tin adducts were observed although no silver adducts were detected.

In contrast to the indium adducts shown in FIG. 9B, the same (or similar) adduct profile was observed for all the charge states of bovine insulin.

Multiple metal ion adducts have also been observed with Central Wire Electrospray Ionisation ("CWESI") ion sources. In a Central Wire Electrospray Ionisation ("CWESI") ion source as disclosed, for example, in U.S. Pat. No. 8,026,478 (the contents of which are incorporated herein by reference) the Electrospray probe is modified by the insertion of a protruding metal wire into the bore of the liquid capillary. This wire may have a sharpened tip that locally enhances the electric field and increases the electron flux density for bombarding electrons.

Figure 11A:
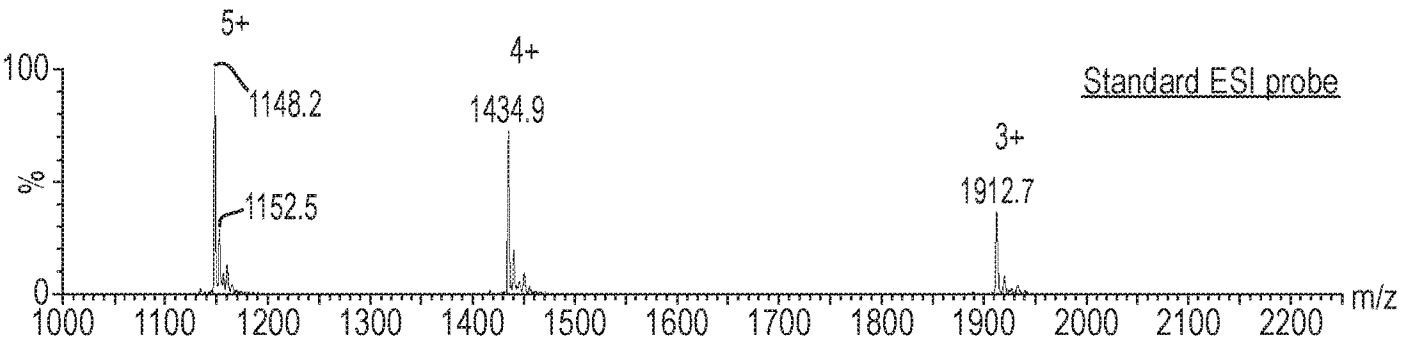
FIG. 11A shows a mass spectrum obtained using an Electrospray ionisation ion source to ionise a bovine insulin sample.
Figure 11B:
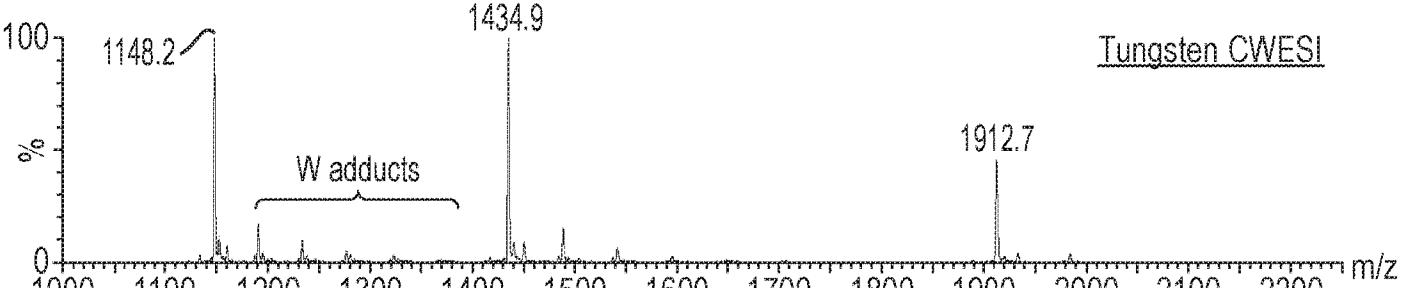
FIG. 11B shows a mass spectrum obtained according to an embodiment using a Central Wire Electrospray Ionisation ("CWESI") ion source having a tungsten central wire to ionise a bovine insulin sample and FIG. 11C shows a mass spectrum obtained according to an embodiment using a Central Wire Electrospray Ionisation ("CWESI") ion source having a copper central wire to ionise a bovine insulin sample.
Figure 11C:
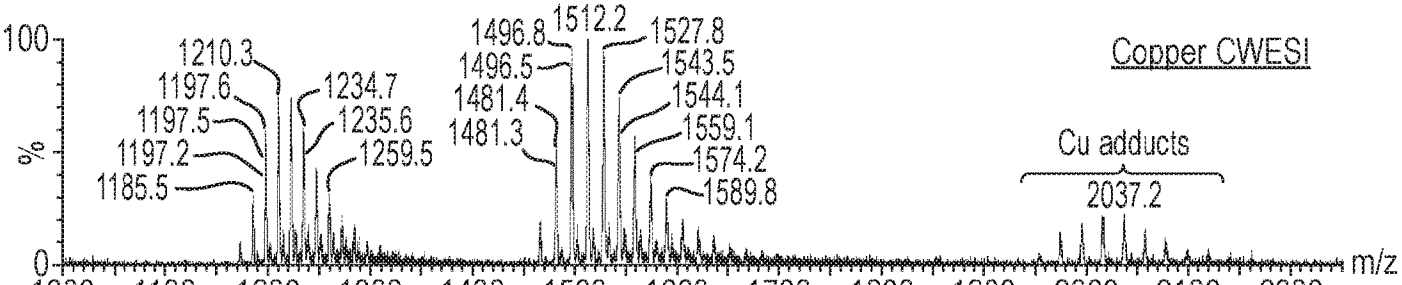
Figure 12A:
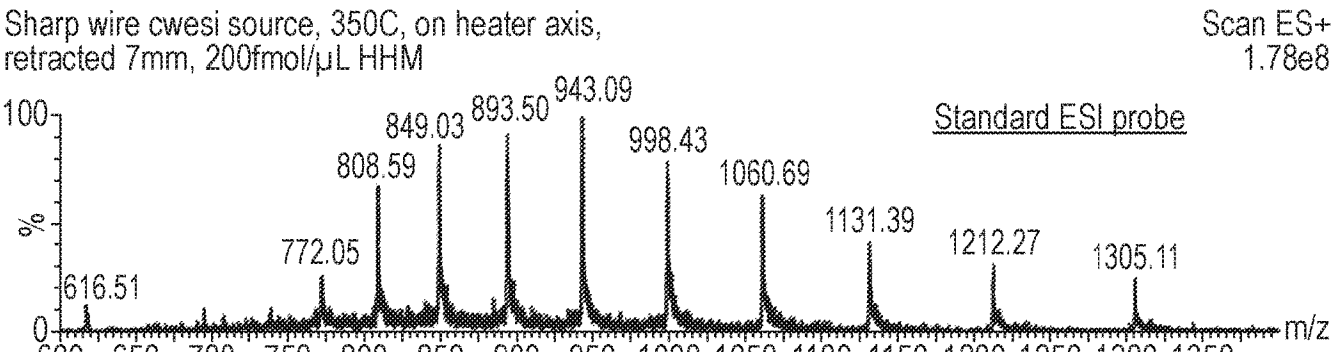
FIG. 12A shows a mass spectrum obtained using a conventional Electrospray ionisation ion source to ionise a horse heart myoglobin ("HHM") sample.
Figure 12B:
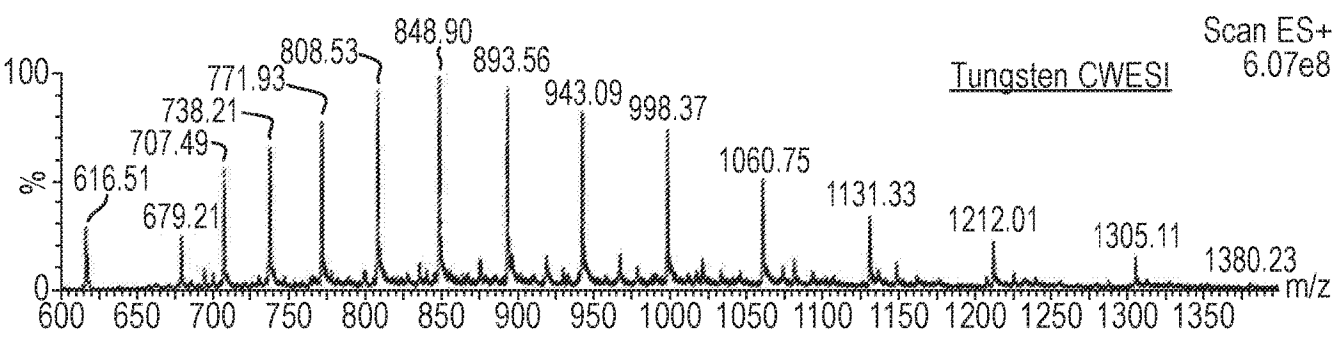
FIG. 12B shows a mass spectrum obtained according to an embodiment using a Central Wire Electrospray Ionisation ("CWESI") ion source having a tungsten central wire to ionise a horse heart myoglobin ("HHM") sample and FIG. 12C shows a mass spectrum obtained according to an embodiment using a Central Wire Electrospray Ionisation ("CWESI") ion source having a copper central wire to ionise a bovine insulin sample.
Figure 12C:
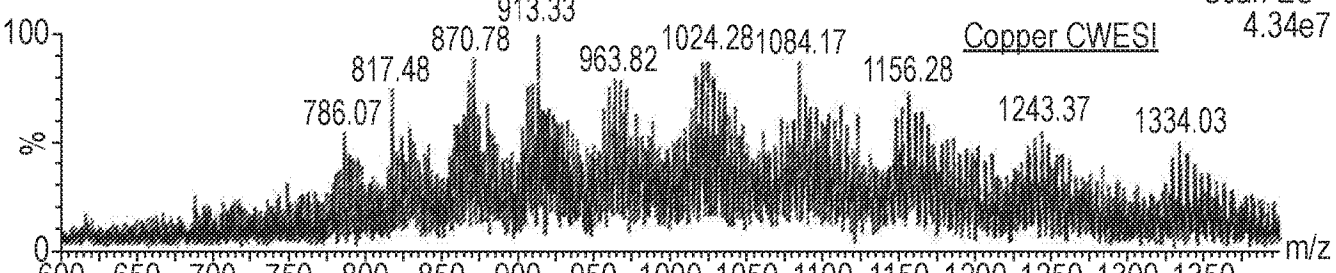

FIGS. 11A, 11B, and 11C show the mass spectra obtained from the analysis of bovine insulin with the use of respectively no central wire (i.e. a conventional Electrospray ionisation ion source), a tungsten central wire and a copper central wire. FIGS. 12A, 12B, and 12C show corresponding mass spectra obtained from the analysis of horse heart myoglobin ("HHM").

As is apparent from these figures, it is shown that both metals can give rise to multiple metal ion adducts, but copper has a greater propensity to form multiple adducts under similar experimental conditions.

Again, in contrast to the indium adducts shown in FIG. 9B, the Central Wire Electrospray Ionisation ("CWESI") adducts are observed on all charge states, and with the same (or similar) adduct profiles for all the charge states.

Table 1 below summarises some general observations from the metals used in an initial study.

TABLE 1

| Material | Melting Point (° C.) | Hardness (Mohs) | Multiple adducts observed in impactor sources | Multiple adducts observed in CWESI sources |
|---|---|---|---|---|
| Indium | 157 | 1.2 | ✓ | Not Tested |
| Tin | 232 | 1.5 | ✓ | Not Tested |
| Lead | 327 | 1.5 | ✓ | Not Tested |
| Magnesium | 651 | 2.5 | X | Not Tested |
| Aluminium | 559 | 2.8 | X | Not Tested |
| Silver | 961 | 2.5 | X | Not Tested |
| Copper | 1083 | 3.0 | X | ✓ |
| Stairless Steel | 1363 | 5.5-6.3 | X | X |

TABLE 1-continued

| Material | Melting Point (° C.) | Hardness (Mohs) | Multiple adducts observed in impactor sources | Multiple adducts observed in CWESI sources |
|---|---|---|---|---|
| Titanium | 1668 | 6.0 | X | Not Tested |
| Tantalum | 3017 | 6.5 | X | Not Tested |
| Tungsten | 3399 | 7.5 | X | ✓ |

The metals are listed in order of increasing melting point and, to a large extent, in order of increasing hardness (decreasing malleability). Column 4 of Table 1 suggests that multiple metal ion adducts may only be observed with low melting point impact surface materials. In contrast, column 5 indicates that multiple adducts may be obtained from higher melting point metals such as copper and tungsten when they are used in a Central Wire Electrospray Ionisation ("CWESI") ion source.

Further testing of the listed materials indicated in Table 1 (results not shown) indicates that the various materials listed in Table 1 (apart from stainless steel) may be used in a Central Wire Electrospray Ionisation ("CWESI") ion source so as to lead to the formation of metal ion adducts. The discharge or pre-breakdown conditions that exist at the tip of a sharpened Central Wire Electrospray Ionisation ("CWESI") wire are believed to result in higher localised temperatures than those observed on the relatively flatter surface of an impact surface target. However, it is also notable that non-oxidising or mildly oxidising metals such as stainless steel do not give rise to significant adducts in a Central Wire Electrospray Ionisation ("CWESI") ion source.

Accordingly, the methods and configurations according to various embodiments enables the formation of multiple metal ion biomolecule adducts, which may result in spectra of biomolecules that may not be significantly observable when using a known ionisation ion source.

The various embodiments therefore are particularly beneficial in that the approach according to various embodiments enables the formation of multiple metal ion biomolecule adducts, which may result in spectra of biomolecules that may not be significantly observable when using a known ionisation ion source, by the straightforward operation of a Central Wire Electrospray Ionisation ("CWESI") ion source.

A particular advantage of the various embodiments is that mass spectra of biomolecules that are otherwise difficult to obtain may be obtained in a quick and simple manner.

Conformational Adduct Analysis

It is known that the generation of adducts by the addition of salts as opposed to the selection of materials for an ion source typically requires the testing of a number of solution concentrations to determine the best concentration in terms of adduct formation and an acceptable level of analyte ion suppression. This can be time consuming and can also lead to unwanted contamination of the source and liquid handling components of the analytical system. In contrast, the use of an appropriate target material to produce adducts in an impact surface source according to various embodiments is easy and does not contaminate the source.

It is known from the literature (e.g. T. G. Flick et al., J Am Soc Mass Spectrom. 2013241654-1662) that nonspecific metal ion adduction to proteins typically results in ions having more compact conformations than the non-adducted forms. These studies are typically performed by adding salts to the analyte solution and ionising the sample with an Electrospray ion source prior to ion mobility mass spectrometry ("IMMS") measurements on selected ion conformations.

It follows that the tarnishable or oxidisable metal impact surface method (e.g. comprising indium or other metal or alloy) described in the present application may be used in combination with ion mobility mass spectrometry ("IMMS") in order to study the effects of metal ion adducts on protein conformation. Such a technique is simple and may provide additional ion conformations due to differences in adducts formed by traditional known techniques and conventional impact surface ionisation techniques.

Accordingly, the methods according to various embodiments enable conformations of a biomolecule to be easily and readily separated and observed by the formation of adducts, without requiring complex and time consuming sample preparation steps to be performed such as the addition of salts which may lead to undesirable contamination of the analytical system, wherein further the methods may provide additional ion conformations.

The various embodiments therefore are particularly advantageous in that the approach according to various embodiments enables conformations of a biomolecule to be easily and readily separated and observed by the formation of adducts, by simply ionising a sample of the biomolecule, without requiring complex and time consuming sample preparation steps to be performed such as the addition of salts which may lead to undesirable contamination of the analytical system, wherein further the methods may provide additional ion conformations.

A particular advantage of the various embodiments is that biomolecules may be separated into different conformer ions in a quick and simple manner.

As discussed above, a simple and unique method of creating multiply adducted indium ions of biomolecules with an indium impactor or impact ionisation ion source may be used to study protein ion conformation by the combined technique of ion mobility/mass spectrometry (IMMS).

Figure 13:
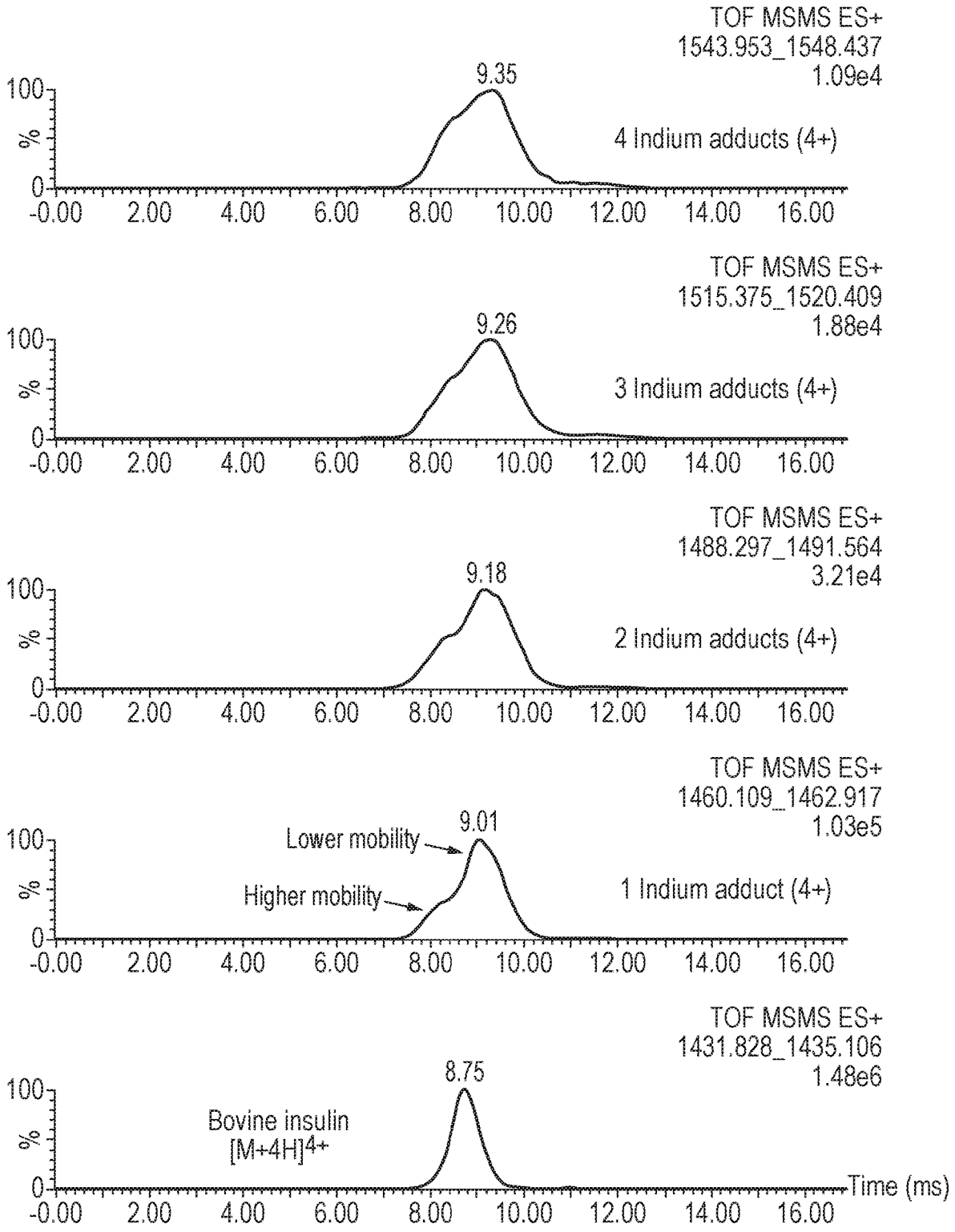
FIG. 13 shows an ion mobility/mass spectrometry ("IMMS") mobility spectra obtained for the unadducted bovine insulin ion $[M+4H]^{4+}$ and the first, second, third and fourth indium adduct ions of the same charge state (4+)

FIG. 13 shows IMMS mobility spectra obtained for the unadducted bovine insulin ion $[M+4H]^{4+}$ and the first, second, third and fourth indium adduct ions of the same charge state (4+). These mobility spectra show that adducted ions have significantly different mobilities, and hence conformations, to the unadducted bovine insulin ions. In particular, the indium-adducted ions appear to exhibit a higher mobility (or mobilities) component and a lower mobility (or mobilities) component where the relative intensity of the higher mobility component appears to increase with increasing number of indium adducts.

Analysis of Ions Using Electron Transfer Dissociation ("ETD") and Electron Capture Dissociation ("ECD")

In addition to the use of indium (or other tarnishable or oxidisable) impact surfaces for removing common salt adducts from complex biomolecules, for probing ion conformations and for metal ion adducting, according to other various embodiments materials such as indium may be used in the study of ion-molecule or ion-ion interactions or reactions. According to various embodiments a method is disclosed comprising using indium-adducted analytes in an Electron Transfer Dissociation ("ETD") experiment.

In a typical Electron Transfer Dissociation ("ETD") experiment, a positively charged bimolecular analyte and a negatively charged reagent radical are allowed to react at low pressure. It is desirable for electron transfer to occur from the reagent to the analyte which results in the production of fragment ions that are not observed in the more commonly known collision induced dissociation ("CID") technique. However, if a proton transfers from the analyte to the reagent, the Electron Transfer Dissociation ("ETD") reaction is nullified and the overall fragmentation efficiency is decreased.

It follows that by replacing the available proton sites on the analyte with ions of a tarnishable or oxidisable metal, such as indium ions, it may be possible to prevent proton transfer to the reagent which could increase fragmentation efficiency. Ions of a tarnishable or oxidisable metal, such as indium ions, may similarly be provided advantageously in an Electron Capture Dissociation ("ECD") technique.

Accordingly, the method according to various embodiments enables ions to be identified using Electron Transfer Dissociation ("ETD") or Electron Capture Dissociation ("ECD") wherein the transfer of a proton from the analyte to the reagent may be prevented, thereby preventing an undesirable reduction in efficiency.

The various aspects therefore are particularly beneficial in that the approach according to various embodiments enables ions to be identified using Electron Transfer Dissociation ("ETD") or Electron Capture Dissociation ("ECD"), wherein the transfer of a proton from the analyte to the reagent may be prevented by simply forming adducts with tarnishable or oxidisable metal ions, such as indium, and by ionising a sample of the analyte.

A particular benefit of the various embodiments is that the undesirable transfer of protons from an analyte to a reagent while analysing the analyte using Electron Transfer Dissociation ("ETD") or Electron Capture Dissociation ("ECD") may be reduced or prevented in a quick and simple manner.

Gas Chase Indium Ions

Although it has been implied that electrolytic reactions are important ion forming processes at electrode surfaces, previous studies (C. F. Rodriquez et al., Int. J. Mass Spectrom. 192 (1999) 303-317) have proposed a gas-phase ion-molecule reaction scheme for the production of metal ion adducts.

In this respect, a saturated ion count was observed in both the experiments of FIGS. 9A and 9B at a nominal mass to charge ("m/z") ratio of 115, which would suggest a strong presence of gas phase indium ions.

As discussed above, although electrolytic solution phase reactions on metal surfaces are commonly believed to give rise to metal ion adducts, the possibility of gas phase reactions with indium metal ions cannot be ruled out since these are abundant in the mass spectrum.

The following experimental data gives strong support to the hypothesis that electrolytic corrosion reactions at the indium impactor surface are responsible for the initial release of indium ions into solution.

Figure 14:
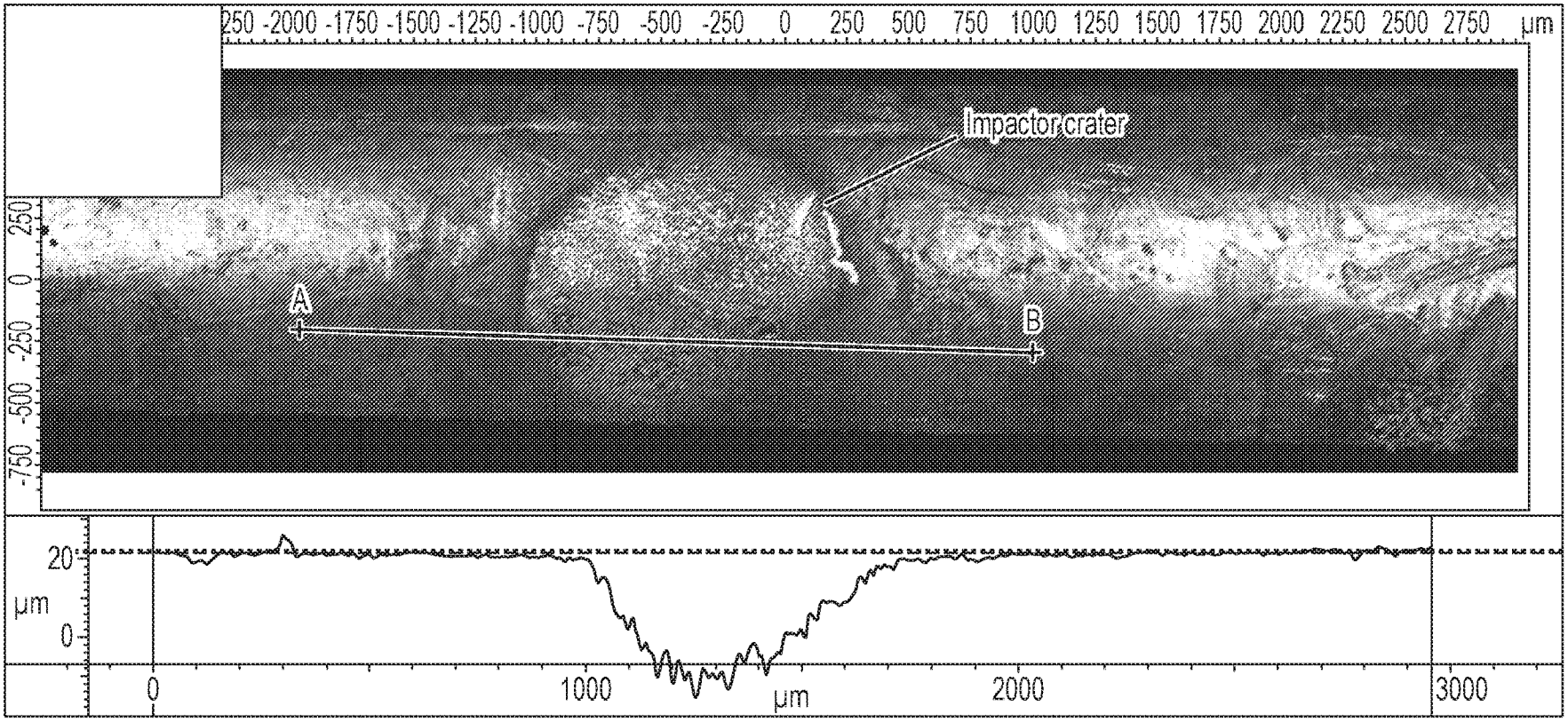
FIG. 14 shows an image of the surface topography of a 1.6 mm diameter indium impactor or impact ionisation source according to an embodiment.

FIG. 14 shows an image of the surface topography of the 1.6 mm diameter indium impactor which was used. This image was obtained on a commercially-available, optical focus variation microscope system. The circular structure in the centre of the image is the spray impact point where high velocity droplets bombard the impactor surface.

The lower trace in FIG. 14 represents the surface profile along the line AB which shows that as much as a 30 μm depth of indium has been removed from the surface at the impact point to produce a crater after only one or two hours of operation. Indium is an extremely malleable material that is readily susceptible to deformation or erosion. If the crater was formed due an erosion-type process, the crater surface would be expected to be composed of platelet microstructures that may include lipped regions.

Figure 15:
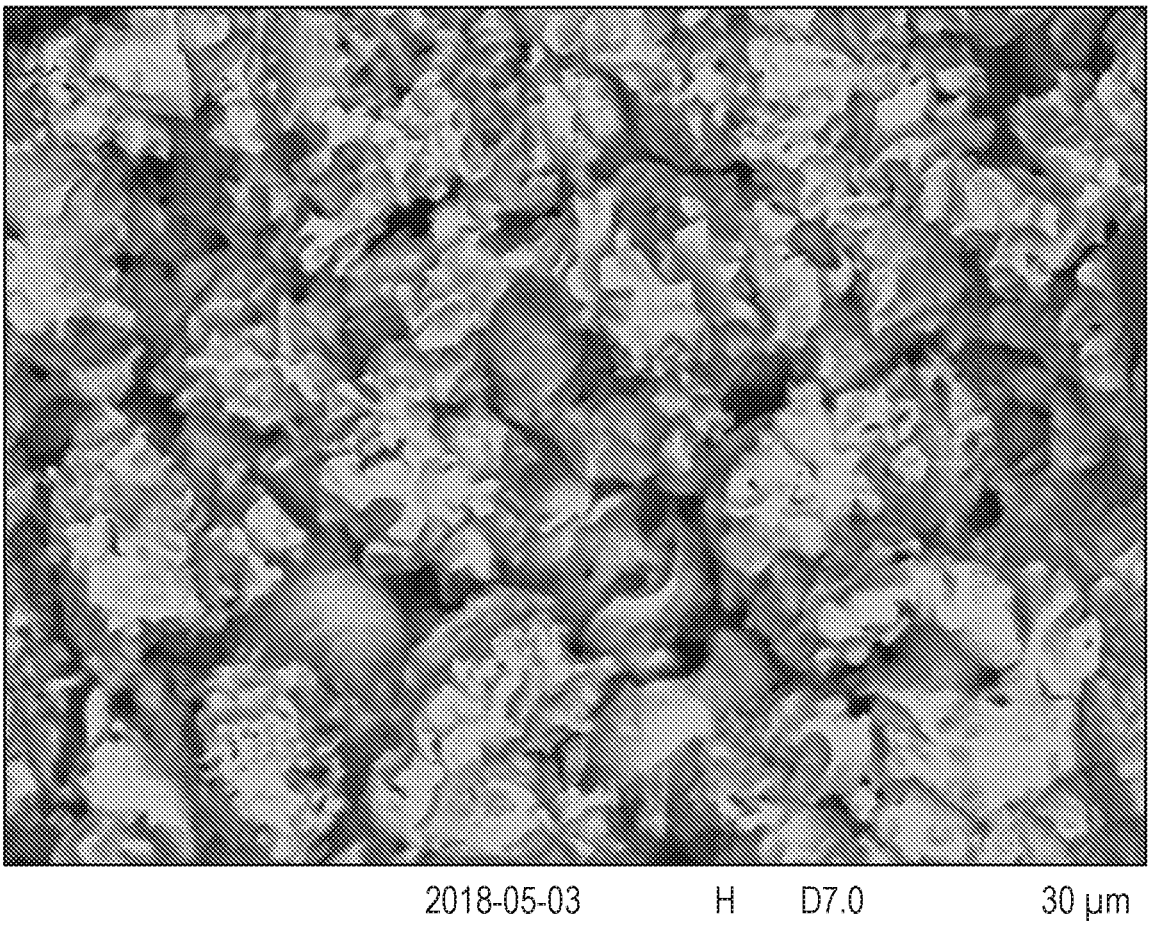
FIG. 15 shows a scanning electron micrograph of an impact zone of the indium impact ionisation source at a magnification of ×3000.

FIG. 15 shows a scanning electron micrograph of the impact zone at a magnification of ×3000. In contrast to an erosion-type topography, the impact zone shows signs of severe corrosion pitting with an absence of platelets, lips or micro-indentations. Indium lies at the lower end of the galvanic series (most noble metals at the top) below cast iron and copper, and, as such, is extremely susceptible to galvanic corrosion.

To determine whether indium adducts can be formed purely by a solution-phase electrolytic pathway, nano-electrospray IMMS experiments were conducted with a platinum or indium wire electrode. An uncoated nano-electrospray glass capillary (exit diameter 2-4 μm) was filled with a bovine insulin solution (50/50 acetonitrile water with 0.1% formic acid) and a platinum or indium wire was inserted into the solution to bias the liquid at +2 kV with respect to the inlet orifice of the IMMS system.

Figure 16:
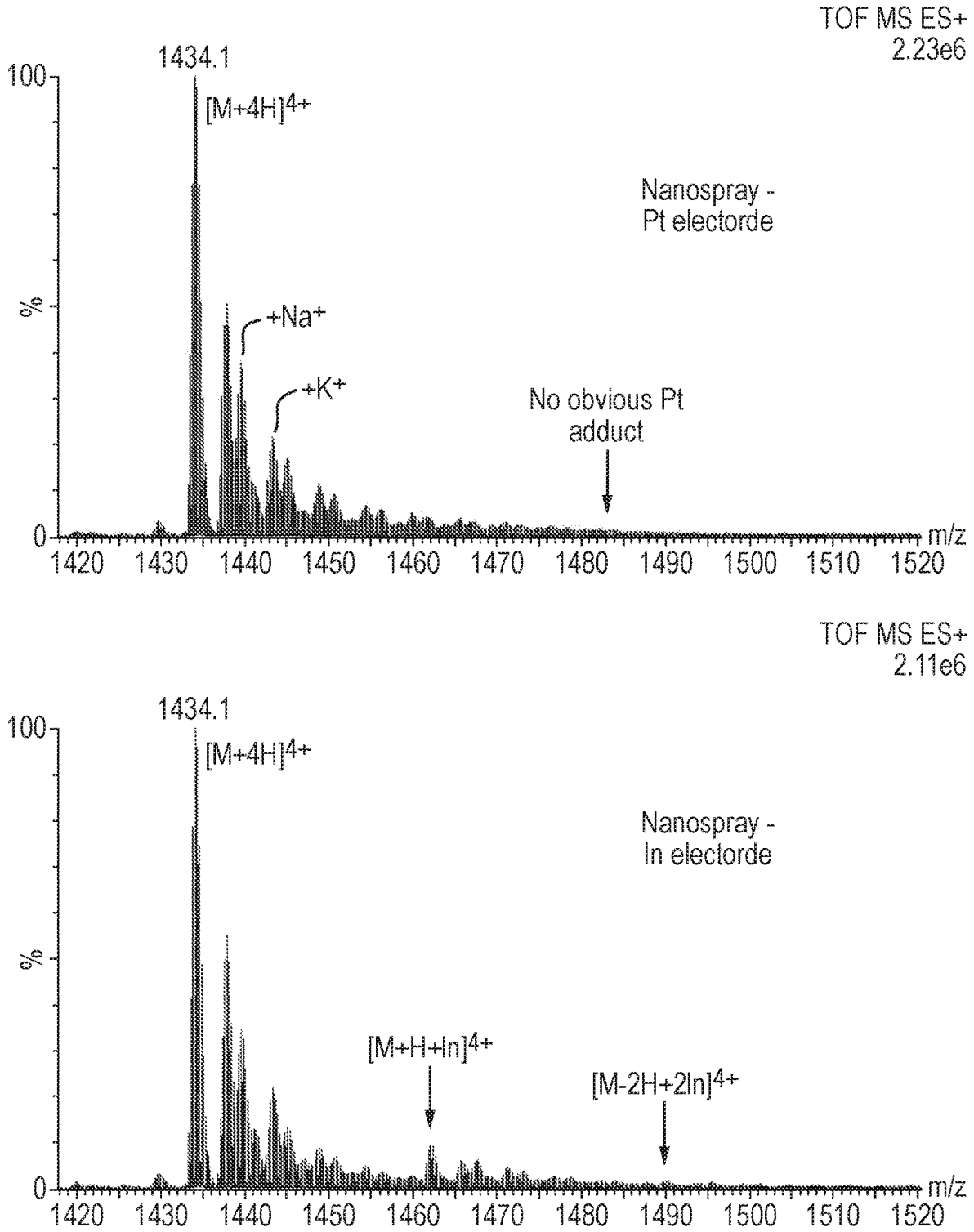
FIG. 16 shows mass spectra relating to nano-spray IMMS experiments which were performed using an unreactive platinum wire electrode and also an indium wire electrode according to various embodiments.

FIG. 16 shows the resulting mass spectra obtained with both electrode materials. Platinum (Pt) is a highly noble, and hence unreactive, metal that shows no trace of a Pt-adduct in the nanospray mass spectrum of FIG. 16.

In contrast, an indium electrode gives rise to at least two detectable In-adducts under these gentle, room temperature ionisation conditions, where these nanospray-derived adduct ions appear to be composed from trivalent indium ($In^{3+}$). Although it seems plausible that the extreme electrolytic conditions that prevail at the surface of the indium impactor or impact ionisation surface during impactor spray ionisation (as evidenced by FIGS. 14 and 15) could give rise to an enhanced, solution-phase adduction process, it is important to note that trivalent indium ions were not observed in the indium impactor experiments (FIG. 9B). Thus, the observation of abundant gas phase $In^{1+}$ ions and multiple, monovalent indium adducts with an indium impact surface does not preclude the possibility of an alternative, gas-phase model of indium adduct-ion formation.

In the context of alternative uses it may be considered that according to various embodiments a metal ion source may be provided by a simple, highly reliable and inexpensive method. The metal ion source may be used to provide metal ions at both atmospheric and vacuum pressures. In the latter case, electrostatic focusing (DC and/or RF) may be used to focus and accelerate the ion beam to high energies. Similarly, a charge neutralisation cell could be used to create a fast atom beam of indium neutrals.

Impact Ionisation

As discussed above, an Electrospray-impact ionisation source and an Electrospray-impact ionisation method may be used according to various embodiments to ionise a sample. An Electrospray-impact ionisation source, as shown in FIG. 1, comprises a nebuliser (i.e., an electrospray probe) 1 maintained at a high voltage, and an impact surface (or target electrode) 5 maintained at ground voltage. The sample is nebulised using the probe to form droplets which are directed towards the target.

The Electrospray-impact ionisation ion source may according to other embodiments be converted into a conventional impact ionisation ion source by reversing the high voltage bias such that the Electrospray probe 1 is grounded and a high voltage is applied to the impact target 5. Although the features detailed below are discussed in the context of a conventional impaction ionisation ion source, they may apply equally to an Electrospray-impact ionisation source.

The nebuliser 1 is preferably arranged and adapted such that the majority of the mass or matter emitted by the nebuliser 1 is in the form of droplets not vapour. For example, at least 50%, 55%, 60%, 65%, 70%, 75%, 80%, 85°/h, 90% or 95% of the mass or matter emitted by the nebuliser 1 may be in the form of droplets.

The nebuliser 1 may be arranged and adapted to emit a stream of droplets wherein the Sauter mean diameter ("SMD", d32) of the droplets is in a range: (i) <5 μm; (ii) 5-10 μm; (iii) 10-15 μm; (iv) 15-20 μm; (v) 20-25 μm; or (vi) >25 μm.

The stream of droplets emitted from the nebuliser 1 may form a stream of secondary droplets after impacting the target 5.

The stream of droplets and/or the stream of secondary droplets may traverse a flow region with a Reynolds number (Re) in the range: (i) <2000; (ii) 2000-2500; (iii) 2500-3000; (iv) 3000-3500; (v) 3500-4000; (vi) 4000-5000; (vii) 5000-6000; (viii) 6000-7000; (ix) 7000-8000; (x) 8000-9000; (xi) 9000-10,000; (xii) 10,000-15,000; (xiii) 15,000-20,000; (xiv) 20,000-25,000; (xv) 25,000-30,000; (xvi) 30,000-35,000; (xvii) >35,000.

At the point of the droplets impacting the target 1 the droplets may have a Weber number (We) selected from the group consisting of: (i) <50; (ii) 50-100; (iii) 100-150; (iv) 150-200; (v) 200-250; (vi) 250-300; (vii) 300-350; (viii) 350-400; (ix) 400-450; (x) 450-500; (xi) 500-550; (xii) 550-600; (xiii) 600-650; (xiv) 650-700; (xv) 700-750; (xvi) 750-800; (xvii) 800-850; (xviii) 850-900; (xix) 900-950; (xx) 950-1000; and (xxi) >1000.

At the point of the droplets impacting the target 5 the droplets may have a Stokes number (Sk) in the range: (i) 1-5; (ii) 5-10; (iii) 10-15; (iv) 15-20; (v) 20-25; (vi) 25-30; (vii) 30-35; (viii) 35-40; (ix) 40-45; (x) 45-50; and (xi) >50.

The mean axial impact velocity of the droplets upon the target 5 may be in the range: (i) <20 m/s; (ii) 20-30 m/s; (iii) 30-40 m/s; (iv) 40-50 m/s; (v) 50-60 m/s; (vi) 60-70 m/s; (vii) 70-80 m/s; (viii) 80-90 m/s; (ix) 90-100 m/s; (x) 100-110 m/s; (xi) 110-120 m/s; (xii) 120-130 m/s; (xiii) 130-140 m/s; (xiv) 140-150 m/s; and (xv) >150 m/s.

The target 5 may be arranged <20 mm, <19 mm, <18 mm, <17 mm, <16 mm, <15 mm, <14 mm, <13 mm, <12 mm, <11 mm, <10 mm, <9 mm, <8 mm, mm, <6 mm, <5 mm, <4 mm, <3 mm or <2 mm from the exit of the nebuliser 1.

The nebuliser 1 may be arranged and adapted to nebulise one or more eluents, wherein the one or more eluents have a liquid flow rate selected from the group consisting of: (i) <1 μL/min; (ii) 1-10 μL/min; (iii) 10-50 μL/min; (iv) 50-100 μL/min; (v) 100-200 (vi) 200-300 μL/min; (vii) 300-400 μL/min; (viii) 400-500 μL/min; (ix) 500-600 μL/min; (x) 600-700 μL/min; (xi) 700-800 μL/min; (xii) 800-900 μL/min; (xiii) 900-1000 μL/min; (xiv) 1000-1500 μL/min; (xv) 1500-2000 μL/min; (xvi) 2000-2500 μL/min; and (xvii) >2500 μL/min.

The nebuliser 1 may comprise a first capillary tube having an exit which emits, in use, the stream of droplets.

The first capillary tube is may be maintained, in use, at a potential: (i) −5 to −4 kV; (ii) −4 to −3 kV; (iii) −3 to −2 kV; (iv) −2 to −1 kV; (v) −1000 to −900 V; (vi) −900 to −800 V; (vii) −800 to −700 V; (viii) −700 to −600 V; (ix) −600 to −500 V; (x) −500 to −400 V; (xi) −400 to −300 V; (xii) −300 to −200 V; (xiii) −200 to −100 V; (xiv) −100 to −90 V; (xv) −90 to −80 V; (xvi) −80 to −70 V; (xvii) −70 to −60 V; (xviii) −60 to −50 V; (xix) −50 to −40 V; (xx) −40 to −30 V; (xxi) −30 to −20 V; (xxii) −20 to −10 V; (xxiii) −10 to 0V; (xxiv) 0-10 V; (xxv) 10-20 V; (xxvi) 20-30 V; (xxvii) 30-40V; (xxviii) 40-50 V; (xxix) 50-60 V; (xxx) 60-70 V; (xxxi) 70-80 V; (xxxii) 80-90 V; (xxxiii) 90-100 V; (xxxiv) 100-200 V; (xxxv) 200-300 V; (xxxvi) 300-400 V; (xxxvii) 400-500 V; (xxxviii) 500-600 V; (xxxix) 600-700 V; (xl)

700-800 V; (xii) 800-900 V; (xiii) 900-1000 V; (xliii) 1-2 kV; (xliv) 2-3 kV; (xiv) 3-4 kV; and (xlvi) 4-5 kV.

The first capillary tube may be maintained, in use, at a potential of: (i) −5 to −4 kV; (ii) −4 to −3 kV; (iii) −3 to −2 kV; (iv) −2 to −1 kV; (v) −1000 to −900 V; (vi) −900 to −800 V; (vii) −800 to −700 V; (viii) −700 to −600 V; (ix) −600 to −500 V; (x) −500 to −400 V; (xi) −400 to −300 V; (xii) −300 to −200 V; (xiii) −200 to −100 V; (xiv) −100 to −90 V; (xv) −90 to −80 V; (xvi) −80 to −70 V; (xvii) −70 to −60 V; (xviii) −60 to −50 V; (xix) −50 to −40 V; (xx) −40 to −30 V; (xxi) −30 to −20 V; (xxii) −20 to −10 V; (xxiii) −10 to 0V; (xxiv) 0-10 V; (xxv) 10-20 V; (xxvi) 20-30 V; (xxvii) 30-40V; (xxviii) 40-50 V; (xxix) 50-60 V; (xxx) 60-70 V; (xxxi) 70-80 V; (xxxii) 80-90 V; (xxxiii) 90-100 V; (xxxiv) 100-200 V; (xxxv) 200-300 V; (xxxvi) 300-400 V; (xxxvii) 400-500 V; (xxxviii) 500-600 V; (xxxix) 600-700 V; (xl) 700-800 V; (xii) 800-900 V; (xiii) 900-1000 V; (xliii) 1-2 kV; (xliv) 2-3 kV; (xiv) 3-4 kV; and (xlvi) 4-5 kV; relative to the potential of an enclosure surrounding the ion source and/or an ion inlet device which leads to a first vacuum stage of a mass spectrometer and/or the target 5.

The exit of the first capillary tube may has a diameter D and the spray of droplets may be arranged to impact on an impact zone of the one or more targets 5.

The impact zone may has a maximum dimension of x and wherein the ratio x/D is in the range<2, 2-5, 5-10, 10-15, 15-20, 20-25, 25-30, 30-35, 35-40 or >40.

The impact zone may have an area selected from the group consisting of: (i) <0.01 $mm^2$; (ii) 0.01-0.10 $mm^2$; (iii) 0.10-0.20 $mm^2$; (iv) 0.20-0.30 $mm^2$; (v) 0.30-0.40 $mm^2$; (vi) 0.40-0.50 $mm^2$; (vii) 0.50-0.60 $mm^2$; (viii) 0.60-0.70 $mm^2$; (ix) 0.70-0.80 $mm^2$; (x) 0.80-0.90 $mm^2$; (xi) 0.90-1.00 $mm^2$; (xii) 10.00-1.10 $mm^2$; (xiii) 10.10-1.20 $mm^2$; (xiv) 10.20-1.30 $mm^2$; (xv) 10.30-1.40 $mm^2$; (xvi) 10.40-1.50 $mm^2$; (xvii) 10.50-1.60 $mm^2$; (xviii) 10.60-1.70 $mm^2$; (xix) 10.70-10.80 $mm^2$; (xx) 10.80-1.90 $mm^2$; (xxi) 10.90-2.00 $mm^2$; (xxii) 2.00-2.10 $mm^2$; (xxiii) 2.10-2.20 $mm^2$; (xxiv) 2.20-2.30 $mm^2$; (xxv) 2.30-2.40 $mm^2$; (xxvi) 2.40-2.50 $mm^2$; (xxvii) 2.50-2.60 $mm^2$; (xxviii) 2.60-2.70 $mm^2$; (xxix) 2.70-2.80 $mm^2$; (xxx) 2.80-2.90 $mm^2$; (xxxi) 2.90-3.00 $mm^2$; (xxxii) 3.00-3.10 $mm^2$; (xxxiii) 3.10-3.20 $mm^2$; (xxxiv) 3.20-3.30 $mm^2$; (xxxv) 3.30-3.40 $mm^2$; (xxxvi) 3.40-3.50 $mm^2$; (xxxvii) 3.50-3.60 $mm^2$; (xxxviii) 3.60-3.70 $mm^2$; (xxxix) 3.70-3.80 $mm^2$; (xl) 3.80-3.90 $mm^2$; and (xli) 3.90-4.00 $mm^2$.

The target 5 may be maintained, in use, at a potential: (i) −5 to −4 kV; (ii) −4 to −3 kV; (iii) −3 to −2 kV; (iv) −2 to −1 kV; (v) −1000 to −900 V; (vi) −900 to −800 V; (vii) −800 to −700 V; (viii) −700 to −600 V; (ix) −600 to −500 V; (x) −500 to −400 V; (xi) −400 to −300 V; (xii) −300 to −200 V; (xiii) −200 to −100 V; (xiv) −100 to −90 V; (xv) −90 to −80 V; (xvi) −80 to −70 V; (xvii) −70 to −60 V; (xviii) −60 to −50 V; (xix) −50 to −40 V; (xx) −40 to −30 V; (xxi) −30 to −20 V; (xxii) −20 to −10 V; (xxiii) −10 to 0V; (xxiv) 0-10 V; (xxv) 10-20 V; (xxvi) 20-30 V; (xxvii) 30-40V; (xxviii) 40-50 V; (xxix) 50-60 V; (xxx) 60-70 V; (xxxi) 70-80 V; (xxxii) 80-90 V; (xxxiii) 90-100 V; (xxxiv) 100-200 V; (xxxv) 200-300 V; (xxxvi) 300-400 V; (xxxvii) 400-500 V; (xxxviii) 500-600 V; (xxxix) 600-700 V; (xl) 700-800 V; (xli) 800-900 V; (xiii) 900-1000 V; (xliii) 1-2 kV; (xliv) 2-3 kV; (xiv) 3-4 kV; and (xlvi) 4-5 kV.

According to an embodiment the targets 5 is maintained, in use, at a potential (i) 5 to −4 kV; (ii) −4 to −3 kV; (iii) −3 to −2 kV; (iv) −2 to −1 kV; (v) −1000 to −900 V; (vi) −900 to 800 V; (vii) −800 to −700 V; (viii) −700 to −600 V; (ix) −600 to −500 V; (x) −500 to −400 V; (xi) −400 to −300 V; (xii) −300 to −200 V; (xiii) −200 to −100 V; (xiv) −100 to −90 V; (xv) −90 to −80 V; (xvi) −80 to −70 V; (xvii) −70 to −60 V; (xviii) −60 to −50 V; (xix) −50 to −40 V; (xx) −40 to −30 V; (xxi) −30 to −20 V; (xxii) −20 to −10 V; (xviii) −10 to 0V; (xxiv) 0-10 V; (xxv) 10-20 V; (xxvi) 20-30 V; (xxvii) 30-40V; (xxviii) 40-50 V; (xxix) 50-60 V; (x) <x) 60-70 V; (xxxi) 70-80 V; (xxxii) 80-90 V; (xxxiii) 90-100 V; (xxxiv) 100-200 V; (xxxv) 200-300 V; (xxxvi) 300-400 V; (xxxvii) 400-500 V; (xxxviii) 500-600 V; (xxxix) 600-700 V; (xl) 700-800 V; (xli) 800-900 V; (xlii) 900-1000 V; (xliii) 1-2 kV; (xliv) 2-3 kV; (xlv) 3-4 kV; and (xlvi) 4-5 kV; relative to the potential of an enclosure surrounding the ion source and/or an ion inlet device which leads to a first vacuum stage of a mass spectrometer and/or the one or more nebulisers 1.

A liquid stream may be converted into a nebulised spray via a concentric flow of high velocity gas without the aid of a high potential difference at the sprayer or nebuliser tip 1, A micro target with comparable dimensions or impact zone to the droplet stream may be positioned in close proximity (e.g. <5 mm) to the sprayer tip to define an impact zone and to partially deflect the spray towards the ion inlet orifice of the mass spectrometer. The resulting ions and charged droplets may be sampled by the first vacuum stage of the mass spectrometer.

Surface Activated Chemical Ionization ("SACI") ion sources are known and are not intended to fall within the scope of the present invention. A SACI ion source directs a vapour stream from a heated nebuliser probe towards a broad area charged target plate which is situated close to the ion inlet aperture of the mass spectrometer and 15-20 mm away from the end of the nebuliser. The spray point of the SACI ion source is within the heated nebuliser probe so that the typical distance between the spray point of the SACI ion source and the target plate is 70 mm. This geometry with a relatively large distance between the sprayer and the target produces a divergent spray with a dispersed reflected flow at the target which generally results in lower sensitivities when compared to optimized ESI and APCI sources.

The spray point of a SACI ion source is within the heated nebuliser probe so that the typical distance between the spray point and a target plate is around 70 mm. By way of contrast, with the preferred impactor ion source the spray point is located at the tip of the inner capillary tube and the distance between the spray point and the target may be <10 mm.

It will be understood by those skilled in the art that a SACI ion source emits a vapour stream and the impact velocity of the vapour upon the target is relatively low and is approximately 4 m/s. By way of contrast, the impactor ion source according to the various embodiments does not emit a vapour stream but instead emits a high density droplet stream. Furthermore, the impact velocity of the droplet stream upon the target is relatively high and may be approximately 100 m/s.

Additionally, the target of an impact ionisation device according to various embodiments has comparable dimensions or impact zone to the droplet stream and may be positioned in close proximity (e.g. <5 mm) to the sprayer tip to define an impact zone and to partially deflect the spray towards the ion inlet orifice of the mass spectrometer. The spray tip and target may be configured in close proximity with a glancing impact geometry which results in increased spray flux at the target and significantly less beam divergence or reflected dispersion when compared to a known broad area SACI ion source.

In atmospheric pressure ionisation (API) ion sources that utilize the SACI ionization technique, a broad area target is maintained at an elevated potential to optimize ion signal. In contrast to SACI, it is apparent from the literature that an elevated target potential, although advantageous, is not essential to the ionization process when using an impact ionisation ion source. In particular, even if the target is maintained at 0 V, ionisation of a sample will still occur. By contrast, a broad area SACI source would lose >90% of the ion signal under the same experimental conditions.

The broad area charged target plate of a SACI ion source may measure, for example, 30 mm×15 mm. As described above a SACI ion source converts a liquid stream into a vapour stream that then impinges on a broad area target. Experiments on SACI (Cristoni et al., J. Mass Spectrom., 2005, 40, 1550) have shown that ionisation occurs as a result of the interaction of neutral analyte molecules in the gas phase with the proton rich surface of the broad area target. In contrast to SACI, the impact ionisation ion source uses a streamlined target to intercept a high velocity stream of liquid droplets which results in a secondary stream consisting of secondary droplets, gas phase neutrals and ions.

The impact ionisation ion source according to various embodiments has the target 5 at a distance of 5 mm from the nebuliser, and typically produces liquid droplets with a Sauter mean diameter in the range 13-20 μm with mean axial velocities in excess of 100 m/s. In embodiments, these very high velocity droplets are well collimated and are typically confined within a radius of 1 mm from the probe axis. According to embodiments, the nebuliser comprises an inner liquid capillary with an internal diameter of 127 μm and an outer diameter of 230 μm. The inner liquid capillary may be surrounded by a gas capillary with an internal diameter of 330 μm that was pressurised to 7 bar.

The heated nebuliser of a typical SACI ion source consists of a pneumatic nebuliser which sprays into a 90 mm long cylindrical tube with a 4 mm diameter bore (tube temperature=600° C.). The number of detectable samples per unit time for the few detected droplets from the SACI ion source heated nebuliser are typically three orders of magnitude lower than those obtained from the pneumatic nebuliser using the impact ionisation ion source of the preferred embodiment. This is a due to the fact that the overwhelming mass of the liquid is vaporised in the SACI-type heated nebuliser resulting in a stream of vapour that contains a very low number density of surviving droplets. Accordingly, a known SACI ion source should be construed as comprising a nebuliser which emits a stream predominantly of vapour and hence a SACI ion source should be understood as not falling within the scope of the present invention.

It can be assumed that the physical model of the impact ionisation ion source according to various embodiments is dominated by the impact of high velocity liquid droplets on a target that is indirectly heated by a source heater. Such impact effects give rise to the formation of secondary droplets, where the nature of the droplet breakup is determined by the Weber number $W_e$ which is given by the following:

$$W_e=\rho U^2 d/\sigma \quad (1)$$

wherein ρ is the droplet density, U is the droplet velocity, d is the droplet diameter and σ is the droplet surface tension.

If it is assumed that the water droplets are at 40° C., the nitrogen gas environment is at 100° C., d=18 μm and U=50 $ms^{-1}$ then a value of $W_e$=640 is obtained for the droplets according to various embodiments. It has been shown (in the literature) that the number of reatomised water droplets increases linearly with $W_e$ in the range 50-750 for impact on a heated steel target for temperatures between 260-400° C. At $W_e$=750, a single droplet typically gave rise to 40 secondary droplets.

It is apparent, therefore, that the impactor target according to various embodiments leads to significant droplet breakup to produce a secondary stream that consists of charged droplets, neutrals, ions and clusters.

The impact efficiency of the system will be largely governed by the Stokes number Sk where:

$$S_k=\rho d^2 U/18\mu a \quad (2)$$

wherein ρ is the droplet density, d is the droplet diameter, U is the droplet velocity, p is the gas viscosity and a is the characteristic dimension of the target.

Impact efficiency increases with increasing $S_k$ and thus favours large droplets with high velocity and a small target diameter. Thus for typical impactor spray conditions described above, it may be expected that $S_k$ has a typical value of 30.

For $S_k$>>1 droplets are highly likely to deviate from the flow streamlines and impact upon the target 5. In contrast, if the target dimension is increased by an order of magnitude and the velocity is decreased by an order of magnitude (i.e. similar conditions to SACI), then the value of $S_k$ drops to 0.3 at which point the droplets are more likely to follow the gas flow around the target 5. The impact efficiency is also known to increase with reducing Reynolds numbers which will further favour the streamlined nature of the impactor spray target 5 according to various embodiments.

The shape of the secondary stream will be governed by the gas flow dynamics and, in particular, the Reynolds number ($R_e$) which is given by:

$$R_e=\rho vL/\mu \quad (3)$$

wherein ρ is the gas density, v is the gas velocity, μ is the gas viscosity and L is the significant dimension of the target.

According to various embodiments, with a 1 mm diameter impactor target 5, a gas velocity of 50 $ms^{-1}$ and nitrogen gas at 100° C. then a value of $R_e$=3000 is obtained.

Reynolds numbers in the range 2000-3000 generally correspond to the transition region from laminar to turbulent flow. Therefore, it can be expected that the wake from the target 5 contains some turbulence and eddy features, However, severe turbulence that could hinder the sampling of ions or droplets at the ion inlet cone is not expected.

Other embodiments are contemplated wherein the distance between the nebulizer tip and the target is very short e.g. 1-3 mm. At such close distances, the gas velocity may be supersonic, where, at for example Mach 1, the local surface Reynolds number to be approximately 30,000 for nitrogen gas at a temperature of 100° C. This extremely high local surface Reynolds number obtained by intercepting a supersonic flow with a target at atmospheric pressure is unique to impactor spray.

As such, an impact ionisation ion source (and similarly an impact-Electrospray ionisation ion source) relates to a particular arrangement with characteristic operating parameters. In particular, an impact ionisation ion source (or impact-Electrospray ionisation ion source) according to various embodiments is quite different to an SACI ion source.

Although the present invention has been described with reference to preferred embodiments, it will be understood by those skilled in the art that various changes in form and detail may be made without departing from the scope of the invention as set forth in the accompanying claims.

The invention claimed is:

1. An ion source comprising:

a nebuliser or electrospray probe for nebulising a sample; and an impact surface or target electrode, wherein the impact surface or target electrode comprises a tarnishable or oxidisable metal or an alloy comprising a tarnishable or oxidisable metal;

wherein the tarnishable or oxidisable metal comprises indium (In); and wherein the impact surface or target electrode is arranged downstream of the nebuliser or electrospray probe and wherein, in use, a stream of uncharged droplets or charged droplets is directed so as to impact upon the impact surface or target electrode so as to form a plurality of analyte ions or secondary ions.

2. An ion source as claimed in claim 1, wherein the impact surface or target electrode is maintained either at: (i) ground or 0V; (ii) a positive potential; or (iii) a negative potential.

3. An ion source as claimed in claim 1, wherein the impact surface or target electrode comprises one or more spike features or projections in order to enhance an electric field in the vicinity of the impact surface or target electrode.

4. An ion source comprising:

a nebuliser or electrospray probe for nebulising a sample; and an impact surface or target electrode, wherein the impact surface or target electrode comprises a tarnishable or oxidisable metal or an alloy comprising a tarnishable or oxidisable metal;

wherein the tarnishable or oxidisable metal comprises gallium (Ga), indium (In) or lead (Pb);

wherein the tarnishable or oxidisable metal or alloy comprising a tarnishable or oxidisable metal has a melting point <1500 K; and wherein the tarnishable or oxidisable metal or alloy comprising a tarnishable or oxidisable metal has a hardness <2.0 Mohs.

5. An ion source as claimed in claim 4, wherein the tarnishable or oxidisable metal or alloy comprising a tarnishable or oxidisable metal has an electronegativity >1.50.

6. An ion source as claimed in claim 4, wherein the tarnishable or oxidisable metal or alloy comprising a tarnishable or oxidisable metal has a melting point >400 K, >410 K, >420 K, >430 K, >440 K, >450 K, >460 K, >470 K, >480 K, >490 K or >500 K.

7. An ion source as claimed in claim 4, wherein the tarnishable or oxidisable metal or alloy comprising a tarnishable or oxidisable metal comprises a post-transition metal.

8. An ion source as claimed in claim 4, wherein the impact surface or target electrode comprises a metal other than a non-corrosive metal or alloy.

9. A method of ionising a sample comprising:

nebulising a sample; and directing the nebulised sample so as to impact upon an impact surface or target electrode so as to form a plurality of analyte ions or secondary ions, wherein the impact surface or target electrode comprises a tarnishable or oxidisable metal or an alloy comprising a tarnishable or oxidisable metal, and wherein the tarnishable or oxidisable metal comprises indium (In).

10. A method of mass spectrometry comprising a method as claimed in claim 9.

* * * * *